United States Patent [19]

Lloyd et al.

[11] 3,978,973

[45] Sept. 7, 1976

[54] MACHINE FOR INVERTING AND STACKING FLAT ARTICLES

[75] Inventors: Allen H. Lloyd, Terrace Park; Edwin A. Molitor, Miami Township, Clermont County; Quentin E. Honnert, Cincinnati; Ronald H. Porter, Milford; Norman P. Crowe, Miami Township, Clermont County, all of Ohio

[73] Assignee: Multifold-International, Inc., Milford, Ohio

[22] Filed: Dec. 12, 1974

[21] Appl. No.: 531,860

[52] U.S. Cl. ..... 198/401; 271/6; 198/404; 198/462; 198/524; 198/544; 198/560

[51] Int. Cl.[2] ..... B65G 47/18; B65H 5/22

[58] Field of Search ..... 271/3, 3 L, 35, 184, 271/185, 212, 6; 198/203, 54, 57, 208, 58, 102

[56] References Cited

UNITED STATES PATENTS

| | | | |
|---|---|---|---|
| 3,776,544 | 12/1973 | Watson | 271/3 |
| 3,781,005 | 12/1973 | Stobb | 271/212 |
| 3,841,622 | 10/1974 | Swanson | 271/3.1 X |

*Primary Examiner*—Allen N. Knowles
*Assistant Examiner*—Hadd Lane
*Attorney, Agent, or Firm*—James W. Pearce; Roy F. Schaeperklaus

[57] ABSTRACT

A machine that receives four rows of completely separated but closely spaced cartons from a customer printing and cutting press, and spaces each carton laterally and longitudinally from its neighbors for non-interference therewith. The machine aligns each independent stream of cartons with the longitudinal dimension of the overall machine and directs the streams of cartons to a switching device intended to control carton traffic to a primary automated stacking process or to an essentially secondary manual stacking process. The primary automated process passes the streams of cartons through an underlapping process, over an inspection table, through an inverting process, into a rate controlling hopper. From the rate controlling hopper, the cartons of each stream pass over a set of laterally disposed conveyors and into a discrete stack of cartons formed within a vertical hopper system that is the output receiver of this machine. The secondary manual stacking process is initiated when the streams of cartons are deflected from the primary process into a scrap chute. Cartons are transported from the scrap chute to the output end of the machine by means of a scrap conveyor.

7 Claims, 33 Drawing Figures

RIGHT SIDE

LEFT SIDE 8
8
14
24
158
156
353
354
362
400
402
388
390
268
232
262
233
366
364
410
486
232S
228
260
226
222
224
174
176
170
218
220

160L
160R
266
266A
266B
266C
10A
12

FIG. 14
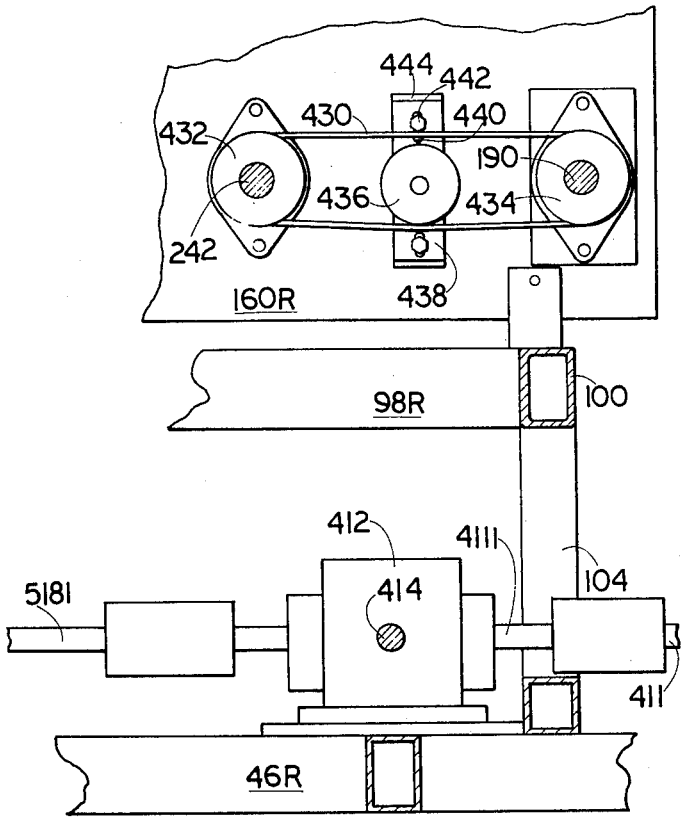
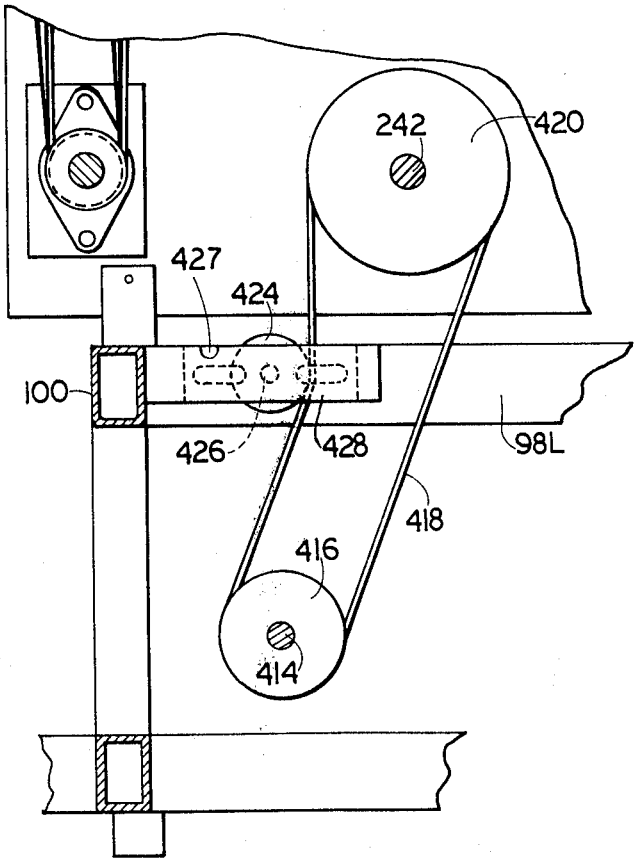
FIG. 15

MACHINE FOR INVERTING AND STACKING FLAT ARTICLES

This invention relates to a machine utilized in the processing of paper cartons. More specifically it relates to a machine which receives freshly printed cartons from a set of scoring and cutting rolls of a printing press, separates the cartons into streams, inverts the cartons and piles the cartons into stacks. This invention relates to improvements in machines of the types shown in Runyan, et al. applications Ser. No. 338,073 filed Mar. 5, 1973, now U.S. Pat. No. 3,861,515 of Jan. 21, 1975, and Ser. No. 258,180 filed May 31, 1972, now U.S. Pat. No. 3,850,314 of Nov. 26, 1974.

An object of this invention is to provide such a machine which first separates cartons transversely of the direction of carton flow into streams and accelerates the cartons to separate the cartons end-from-end in the streams, then directs the cartons between straightening rolls which direct the cartons lengthwise of the direction of carton flow so that the streams progress in parallelism to pass diverting means which cause the trailing edge of each carton to be diverted from the path of the leading edge of the next following carton, then passes the cartons through shingling rolls which advance the cartons at a slower rate than that at which the cartons are delivered to the machine so that the cartons are formed into shingled streams which advance in parallelism.

A further object of this invention is to provide such a machine which advances each shingled stream of cartons through an arc of 180 degrees in a rollover conveyor to invert the cartons in the stream and deposits the cartons of the stream in a cross conveyor hopper in inverted position.

A further object of this invention is to provide such a machine in which the cartons are fed from the bottom of the cross conveyor hopper into carton stacking mechanism.

A further object of this invention is to provide such a machine in which the means for feeding the cartons from the cross conveyor hopper includes central conveyor means which extends across the central portion of the cross conveyor hopper and side conveyor means receiving side portions of the cartons on opposite sides of the central conveyor means and extending from adjacent the hopper to the carton stacking mechanism, the central conveyor means and the side conveyor means engaging the cartons at three positions to advance the cartons from the bottom of the cross conveyor hopper.

A further object of this invention is to provide such a machine in which a constant head of cartons is maintained in the cross conveyor hopper so that cartons are delivered by the conveyor means of the cross conveyor hopper in a steady and smooth stream.

A further object of this invention is to provide a machine which receives quadruple streams of cartons and processes them into a plurality of stacks of cartons that are found face down in a pair of vertical hoppers appropriate for further processing.

A further object of this invention is to provide a machine which receives quadruple streams of cartons, and by the option of an operator, transports them through an alternate or scrap conveyor in a face-up and shingled stream, to be manually stacked and then inverted for further processing through customer machinery.

A further object of this invention is to provide a machine which receives four interfering streams of cartons and through a discrete separator assembly, separates each carton both longitudinally and laterally from its neighbors in the matrix of a plurality of streams of carton blanks.

A further object of this invention is to provide such a machine in which there is a straightening assembly, to stop the lateral movement of the carton blanks upon exit from the separator assembly and to re-establish purely longitudinal movement of the four streams of cartons through the stacking machine.

A further object is to provide a machine by means of which an operator can use diverting means for rejecting unacceptable carton blanks produced by the printing press from the automatic stacking process to the scrap conveyor for manual disposal thereof.

A further object of this invention is to provide a machine in which a set of cross conveyors moves the streams of cartons laterally from the output end of a rollover conveyor to vertical hoppers within which the stacks of cartons are formed.

Another object of this invention is to provide a three-point belt suspension system at the bottom of each of the cross conveyor hoppers for bottom feed therefrom, required by the fact that the cartons can be warped.

A further object of this invention is to provide cross conveyors that operate at a rate which varies according to the quantity of cartons stored in the cross conveyor hoppers.

Briefly, this invention provides a pickoff assembly that receives a quadruple stream of cartons from a customer printing and cutting machine. The pickoff assembly provides a separator that translates individual cartons of the quadruple stream of cartons laterally and longitudinally to a point of non-interference with each other. A straightening assembly restores the separated streams of cartons to purely longitudinal movement before entering a diverter assembly. The diverter assembly permits an operator to select a primary and automated stacking process, or a secondary and manual stacking process. In the primary process the cartons pass a diverter assembly in normal position, a shingling assembly, a table conveyor, a rollover conveyor, a set of cross conveyor rate hoppers, a set of cross conveyors with vertical hoppers that function as an output receiver for the primary process.

In the second process the diverter assembly in an up position directs the cartons down a scrap chute onto a scrap conveyor.

The above and other objects and features of the invention will be apparent to those skilled in the art to which this invention pertains from the following detailed description and the drawings, in which:

FIG. 14 is an enlarged fragmentary view in section generally taken on the line 14—14 in FIG. 5;

FIG. 15 is an enlarged fragmentary view in section taken on the line 15—15 in FIG. 5;

General Description

Figures 1, 1A, 1B, 1C, 1D, 1E:
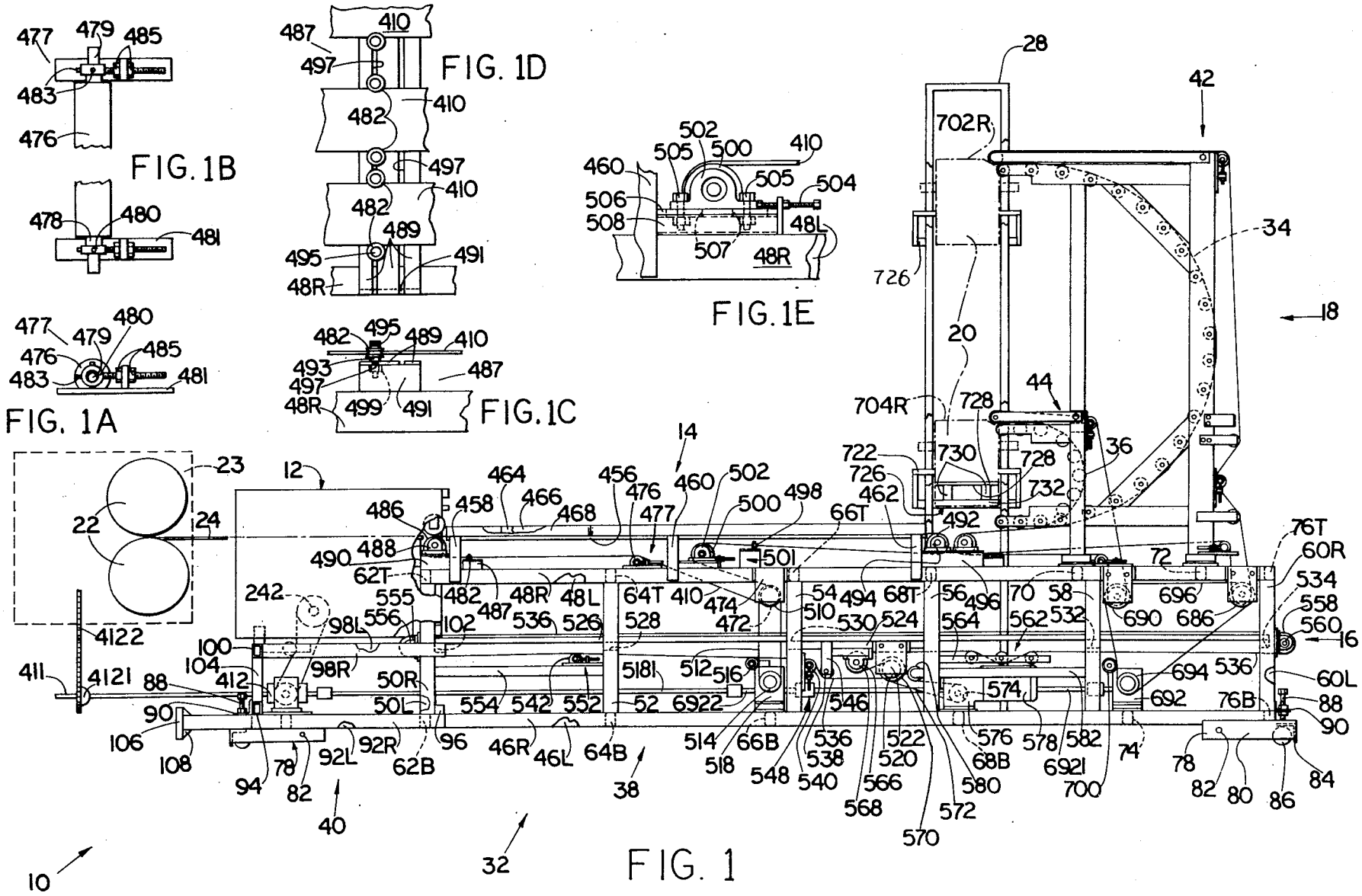
FIG. 1 is a view in side elevation of a quadruple carton stacking machine constructed in accordance with an embodiment of this invention, parts being broken away to reveal details of construction, cross conveyors being shown in dot-dash lines, a printing press being indicated in dashed lines.
FIG. 1A is an enlarged view in side elevation of an idler eyebolt mounting assembly employed in the machine.
FIG. 1B is an enlarged plan view of the idler eyebolt mounting assembly of FIG. 1A, the center section being deleted.
FIG. 1C is an enlarged view in side elevation of a guide pulley mount assembly employed in the machine.
FIG. 1D is an enlarged fragmentary plan view of the guide pulley mount shown in FIG. 1C.
FIG. 1E is an enlarged view in side elevation of a belt takeup roll assembly used in the machine.

In the following detailed description and the drawings, like reference characters indicate like parts.

Figures 7, 8, 9:
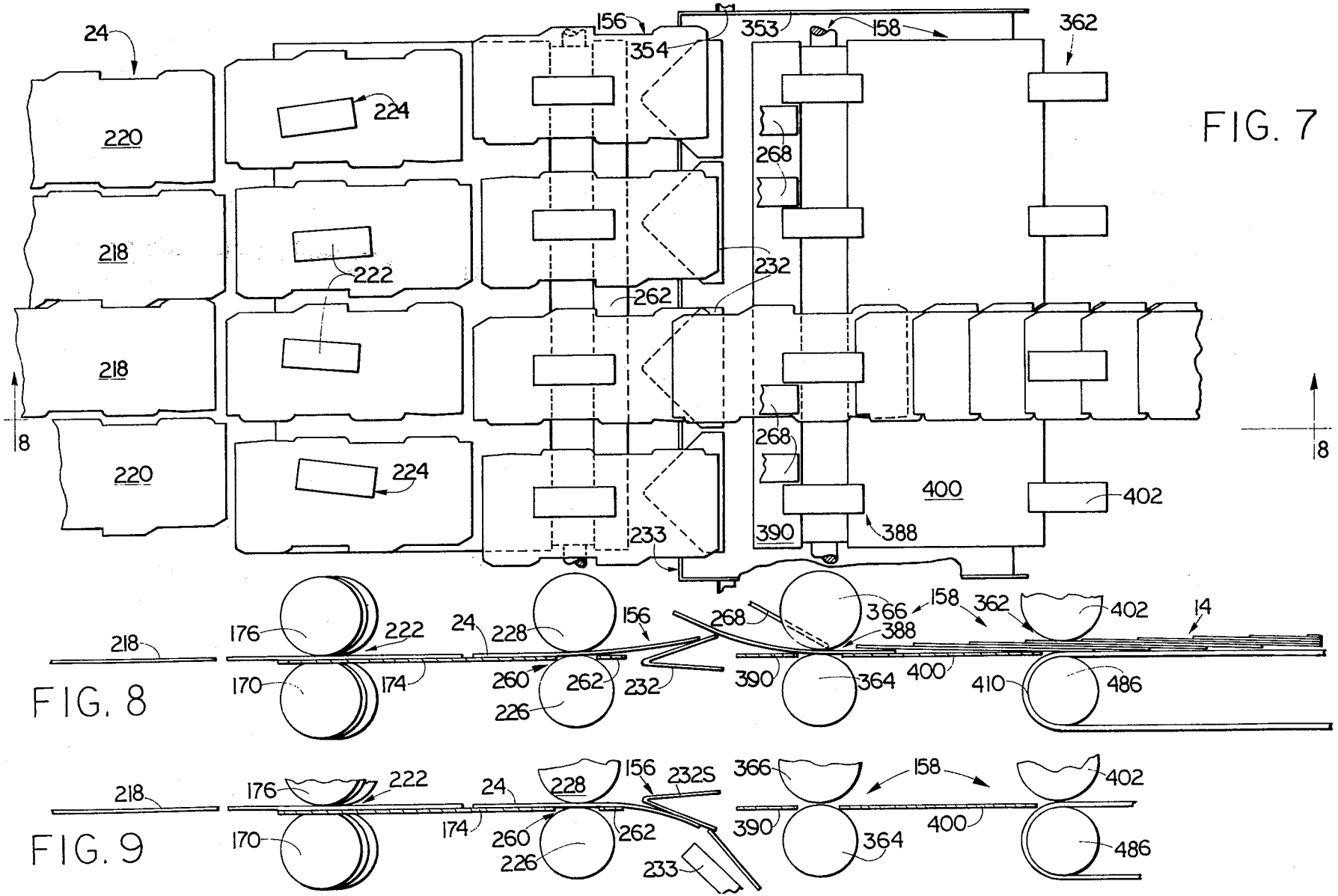
FIG. 7 is an enlarged schematic plan view of streams of cartons as they are processed through the pickoff section of the machine.
FIG. 8 is a schematic view in section taken generally on the line 8—8 in FIG. 7 depicting a stream of cartons being processed normally through a discriminator and shingling section of an input or pickoff section of the machine.
FIG. 9 is a schematic view in section taken generally on the line 8—8 in FIG. 7 depicting a stream of cartons being processed abnormally out of the discriminator and into a scrap section of the pickoff section of the machine.
Figure 24:
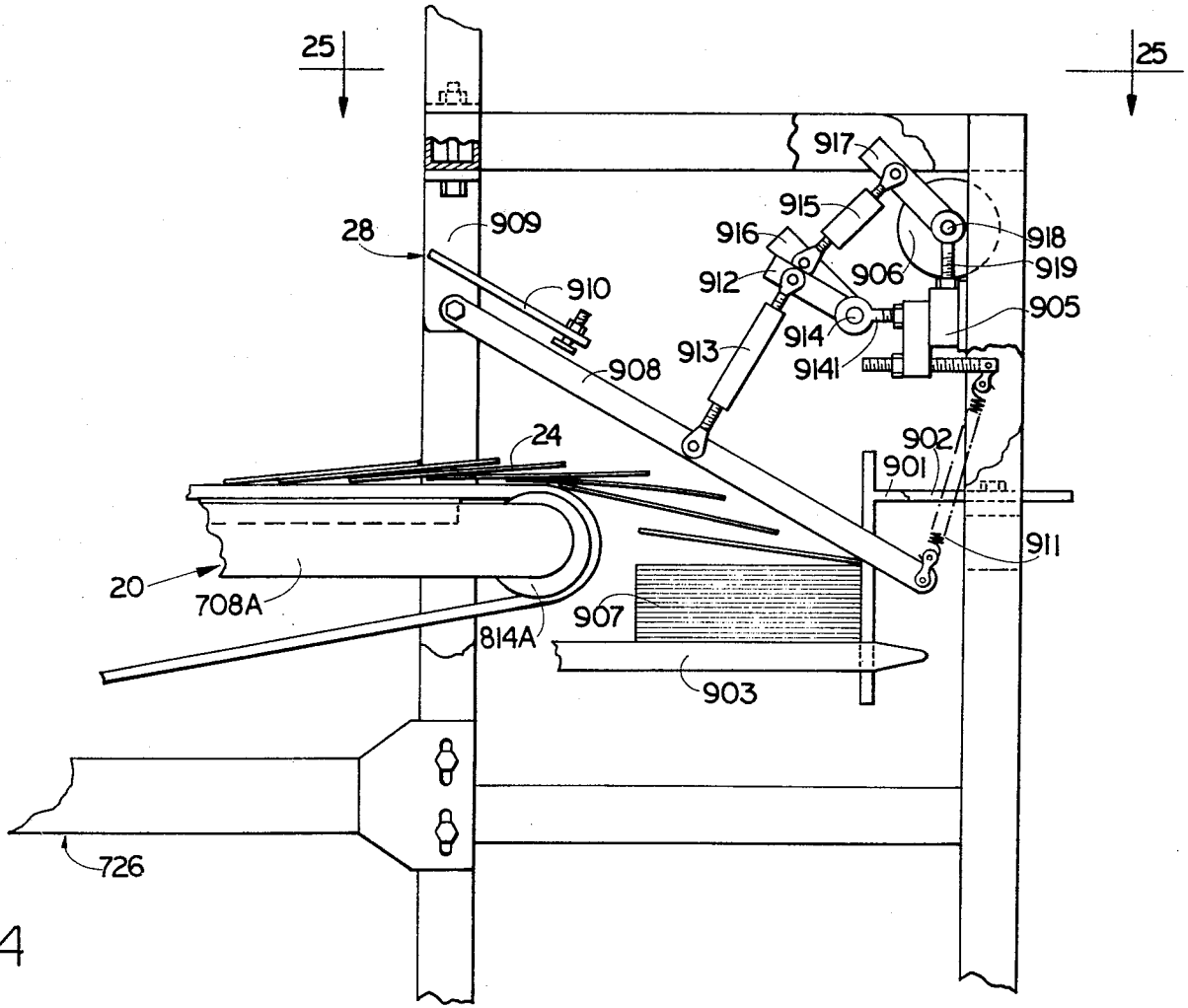
FIG. 24 is a fragmentary view in side elevation showing a part of one of the main hoppers, a portion of one of the cross conveyors and a fragmentary portion of stack supporting apparatus of the machine.
Figure 25:
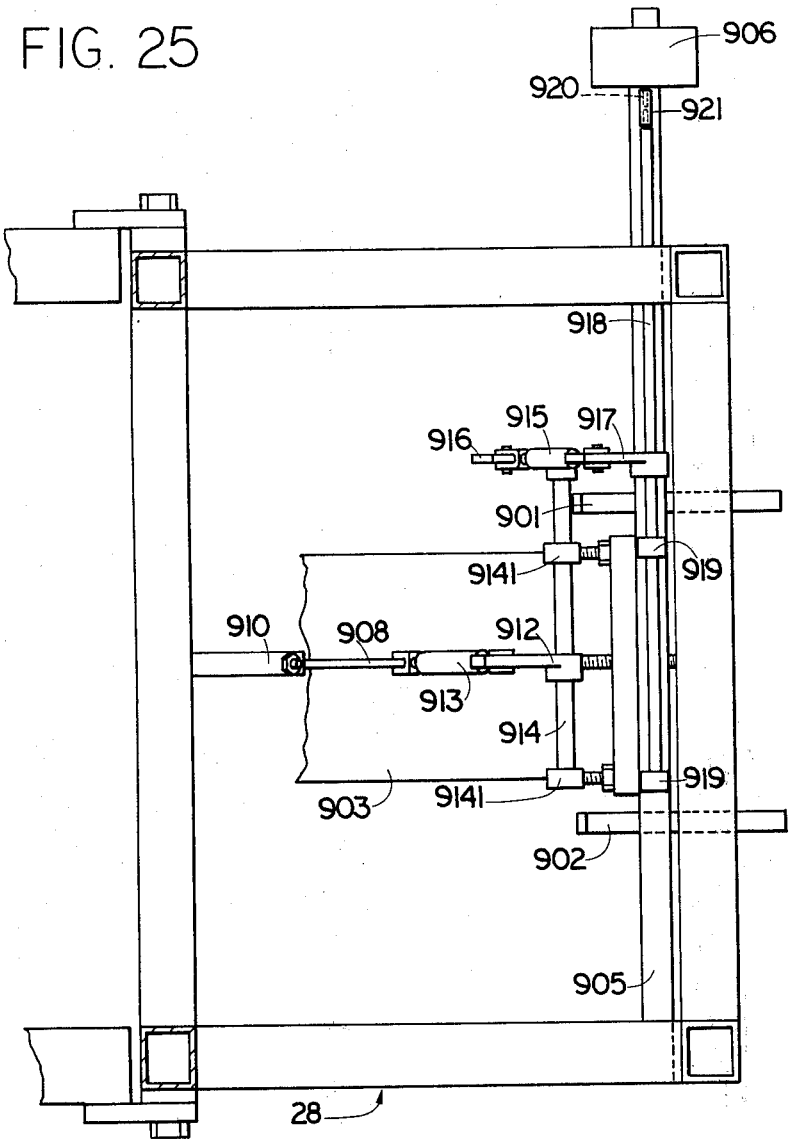
FIG. 25 is a view in section taken on the line 25—25 in FIG. 24, conveyors and cartons being omitted for clarity.
Figure 26:
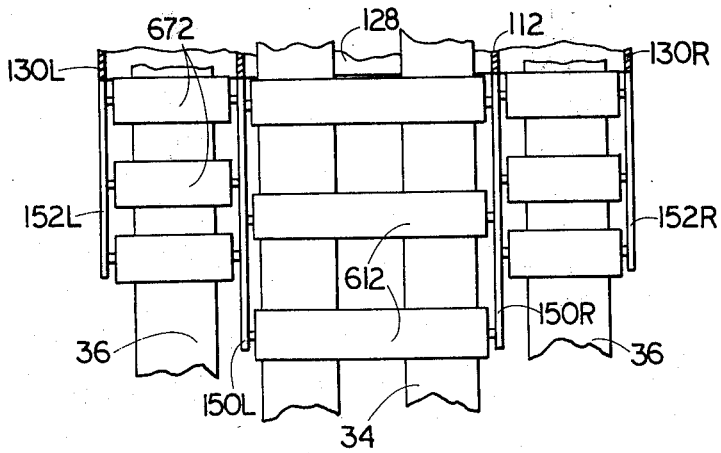
FIG. 26 is a view in section taken on the line 26—26 in FIG. 3.

FIG. 1 shows a quadruple stacker machine 10 which is constructed in accordance with an embodiment of this invention. The quadruple stacker 10 is comprised of an input or pickoff section 12, a table conveyor 14, a scrap conveyor 16, a rollover conveyor 18, and a set of four cross conveyors 20 that is shown in dot-dash lines in FIGS. 1 and 2. A set of scoring and cutting rolls 22 performs the terminal operation of a printing press 23 (not shown in detail) that provides quadruple streams of cartons 24 (FIGS. 2 and 7) as input material to the quadruple stacker 10 in the manner cartons 218 and 220 are shown in FIG. 7. The quadruple stacker 10 (FIG. 1) processes each stream of the quadruple streams of cartons (FIG. 1) into a stack 907 of cartons as shown in FIG. 24 that is delivered by the respective cross conveyor of the set of four cross conveyors 20 to one of a pair of vertical main hoppers 28 that function as the output receiver to the quadruple stacker 10.

Figure 2:
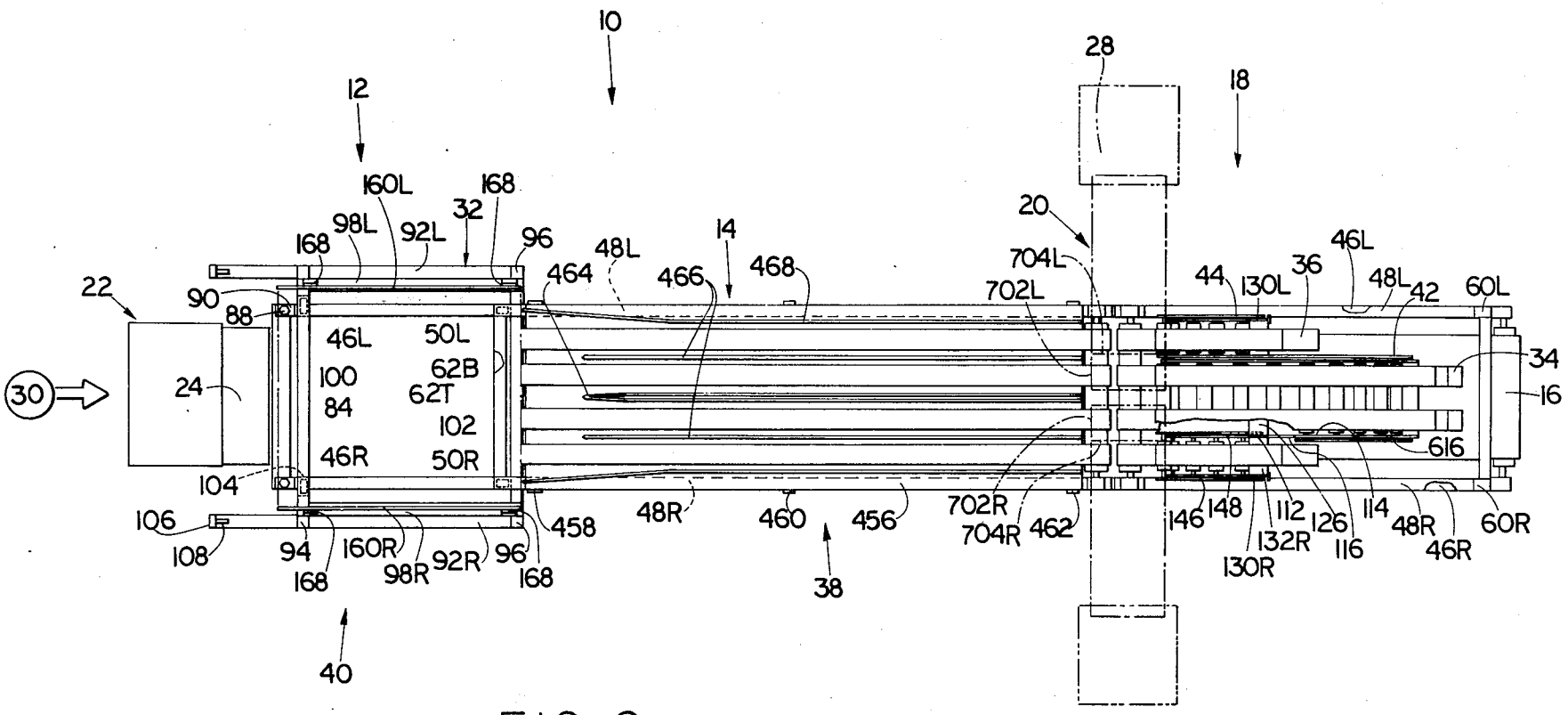
FIG. 2 is a plan view of the quadruple carton stacking machine showing input and output devices in schematic form, some details of mounting structures being omitted for clarity, cross conveyors and main hoppers of the machine being indicated in dot-dash lines an double-dot-dash lines respectively.

Referring to FIG. 2, the quadruple streams of cartons 24 pass through the pickoff machine 12, and onto the table conveyor 14, and from there into the rollover conveyor 18 where each stream begins a vertical rise in a turnover process. This direction of card movement will hereinafter be referred to as the primary direction of carton flow. Reverse carton flow will refer to that portion of the process where the cartons are moving in opposition to the primary direction of flow when considered from the plan view point of view. From the same point of view, cartons moving along the set of four cross conveyors 20 and into the pair of vertical hoppers 28 will hereinafter be referred to as moving along the secondary direction of flow. In general, the words input and output should be interpreted in view of the local direction of carton flow. The longitudinal direction is hereby defined as that direction that is parallel to the direction of primary carton flow. The lateral direction is perpendicular to any longitudinal line and lies in a horizontal plane. Now consider an observer 30 (FIG. 2) standing at the input end of the quadruple stacker 10 and looking in the direction of primary carton flow. The right side of the machine is hereby defined as the right hand side of the observer 30, and, similarly, the left side of the machine is synonymous with the observer's left side. The observer 30 consequently views each major part of the machine in a vertical picture plane, and the side of each component that lies in the observer's picture plane will be hereinafter referred to as the front of that component. The back of any component is directly opposed to the front of that component.

The Basic Framework

The pickoff machine 12, the table conveyor 14, the scrap conveyor 16 and the rollover conveyor 18 are fixedly held in spaced relationship with each other by means of a basic framework 32, as is shown in FIGS. 1 and 2. The rollover conveyor 18 is comprised of a pair of center turnover conveyors 34 and a pair of short turnover conveyors 36. The basic framework 32 is comprised of a table and scrap conveyor support frame 38, a pickoff mount frame 40, a center turnover conveyor frame 42 and a short turnover conveyor frame 44.

The table and scrap conveyor support frame 38 incorporates a pair of bottom stringers 46R and 46L and a pair of top stringers 48R and 48L. The pair of top stringers 48R and 48L is rigidly held in vertical and parallel spaced relationship with the pair of bottom stringers 46R and 46L by mean of a pair of conveyor input posts 50R and 50L, a pair of conveyor input mid-posts 52 (FIG. 1), a pair of conveyor output mid-posts 54, a pair of conveyor output posts 56, a pair of short turnover posts 58 and a pair of end posts 60R and 60L. The right and left hand sides of the table and scrap conveyor support frame 38 are rigidly held in lateral spaced relationship by means of a pair of input lateral tubes 62T and 62B, a pair of input mid-lateral tubes 64T and 64B, a pair of output mid-lateral tubes 66T and 66B, a pair of output lateral tubes 68T and 68B, a short turnover lateral mount 70, a center turnover lateral mount 72, a rollover bottom brace 74, and a pair of end lateral tubes 76T and 76B.

The table and scrap conveyor support frame 38 is adjustably suspended above the floor by means of a pair of dolly assemblies 78, one mounted at the input end and the other at the output end of the table and scrap conveyor support frame 38 as shown in FIG. 1. Each of the pair of dolly assemblies 78 incorporates a pair of dolly radius arms 80 that is pivotally mounted to the pair of bottom stringers 46R and 46L by means of a pair of pivot pins 82. The opposite ends of the pair of dolly radius arms 80 are rigidly held in parallel lateral alignment by means of a dolly angle iron 84. A pair of dolly wheels 86 is rotatably mounted between the ends of the pair of dolly radius arms 80 and adjacent to the dolly angle iron 84. A pair of adjuusting lugs 88 is threadably mounted through a pair of leg mounts 90. The pair of leg mounts 90 that associate with the dolly assembly at the input end of the table and scrap conveyor support frame 38 is fixedly attached to an input lateral member 94, whereas the pair of leg mounts 90 that associate with the dolly assembly at the output end of the table and scrap conveyor 38 is fixedly attached to the pair of end posts 60R and 60L. Each of the pair of adjusting lugs 88 can be turned against the associated dolly angle iron 84 to adjust the table and scrap conveyor support frame 38 with respect to the floor. Each of the pair of dolly wheels 86 provides a degree of longitudinal freedom to the quadruple stacker 10 to assist in alignment procedures during installation of the machine.

The pickoff mount frame 40 is comprised of a pair of pickoff bottom stringers 92Rl and 92L, as can be seen in FIGS. 1 and 2. The stringers 92R and 92L are rigidly affixed in lateral displaced alignment by means of the input lateral member 94 and a pickoff output lateral member 96. The input lateral member 94 and the pickoff output lateral member 96 are rigidly affixed across the top of the pair of bottom stringers 46R and 46L and the pair of pickoff bottom stringers 92R and 92L. The pickoff mount frame 40 also incorporates a pair of longitudinal pickoff mounts 98R and 98L that is held in lateral spaced relationship with respect to the table and scrap conveyor support frame 38 by means of an input lateral top member 100 and a pickoff output top lateral member 102. The pickoff output top lateral member 102 is rigidly affixed to the output face of the pair of conveyor input posts 50R and 50L. The pair of longitudinal pickoff mounts 98R and 98L is in turn rigidly affixed to the ends of the pickoff output top lateral member 102. The input lateral top member 100 is rigidly affixed across the input ends of the pair of longitudinal pickoff mounts 98R and 98L. The input lateral top member 100 is held in fixed vertical spaced relationship with the input lateral member 94 by means of a pair of input vertical posts 104 that is placed in longitudinal alignment with and at the ends of the pair of bottom stringers 46R and 46L. The input end of the pair of pickoff bottom stringers 92R and 92L is fixedly fitted with a pair of butt plates 106 and is strengthened by a set of four braces 108 rigidly affixed therebetween.

The center turnover conveyor frame 42 and the short turnover conveyor frame 44 integrate with each other to form the framework for the rollover conveyor 18 as will be described herein.

Figure 3:
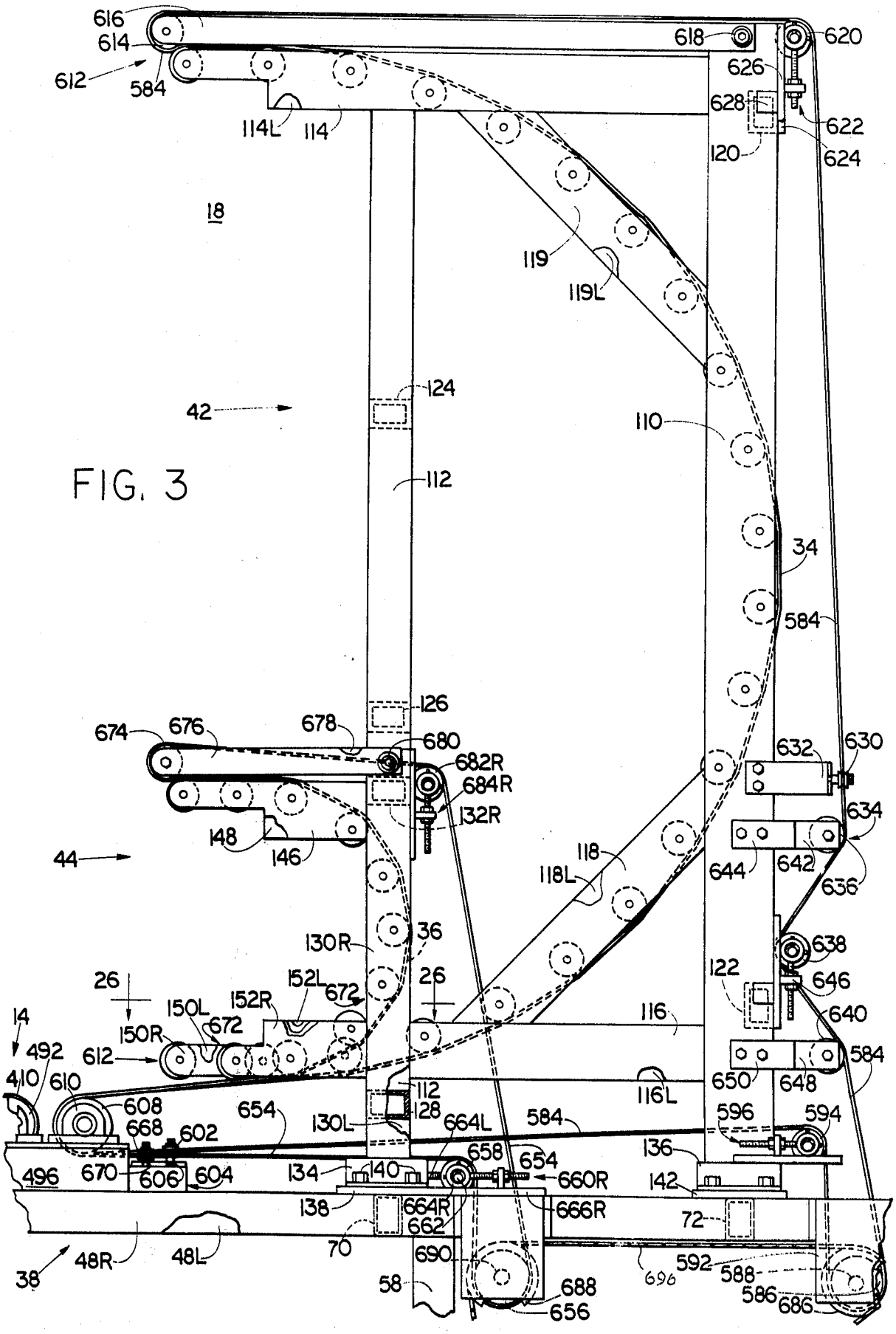
FIG. 3 is an enlarged view in side elevation of a turnover conveyor section of the machine partly broken away to reveal details of structure.
Figure 4:
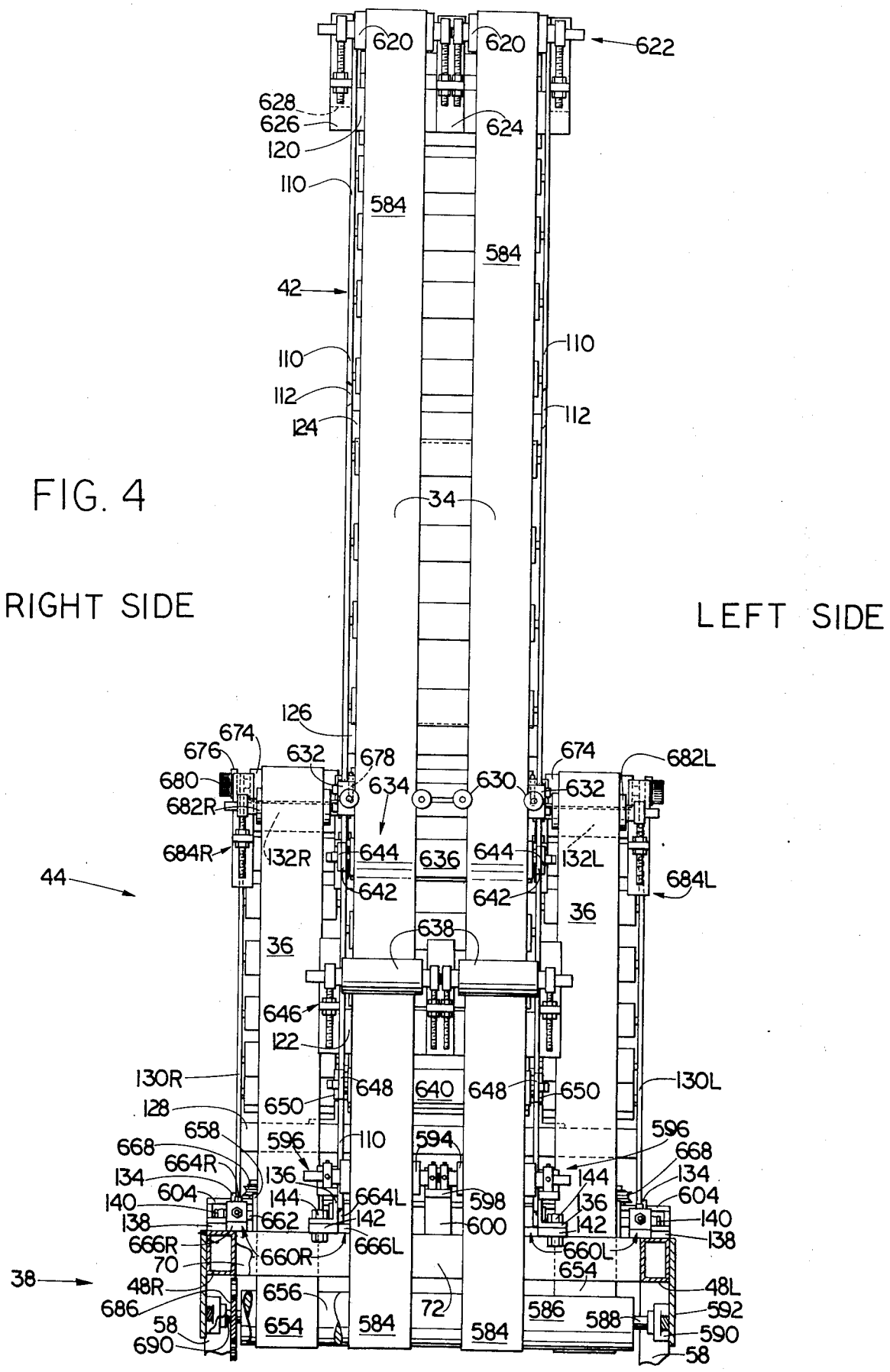
FIG. 4 is an enlarged view in back elevation of the turnover conveyor section of the machine.

The center turnover conveyor frame 42, as shown in FIGS. 3 and 4, comprises a pair of center output risers 110, a pair of center input risers 112, a pair of center conveyor output plate members 114 and 114L and a pair of center conveyor input plate members 116 and 116L. Each of the pair of center conveyor output members 114 and 114L is rigidly affixed on top of one of the pair of center input risers 112 and is also rigidly affixed at its output end to the front narrow face of one of the pair of center output risers 110. Each of the pair of center conveyor input members 116 and 116L is rigidly affixed at its ends to the back face of one of the pair of center input risers 112 and the front face of one of the pair of center output risers 110, thus providing parallel rigid alignment therebetween. A pair of bottom corner braces 118 and 118L is rigidly affixed at its ends and in a flush manner to the pair of center conveyor input members 116 and 116L and the pair of center output risers 110. In a similar manner, a pair of top corner braces 119 and 119L is rigidly affixed at its end and in a flush manner to the pair of center output risers 110 and the pair of center conveyor output members 114. This combination of structural members forms a rectangular framework as can be seen in FIG. 3. The right and left hand sides of the center turnover conveyor frame 42 are fixedly held in lateral spaced relationship by means of a top output lateral brace 120 and a bottom output lateral brace 122 rigidly affixed between the pair of center output risers 110, and a top input lateral brace 124 and a middle input lateral brace 126 that are rigidly affixed at their ends between the pair of center input risers 112. A bottom input lateral brace 128 is rigidly affixed to the bottom ends of the pair of center input risers 112 and extends laterally to the approximate width of the table and scrap conveyor support frame 38 as shown in FIG. 4.

The short turnover conveyor frame 44 incorporates a pair of outer input risers 130R and 130L that is rigidly affixed in a vertical disposition to the outer ends of the bottom input lateral brace 128 as shown in FIGS. 3 and 4. The top ends of the pair of outer input risers 130R and 130L are rigidly held in lateral spaced relationship with the pair of center input risers 112 by means of a pair of short conveyor top lateral braces 132R and 132L. The short turnover conveyor frame 44 is thereby rigidly affixed to the center turnover conveyor frame 42 thus forming the framework for the roll over conveyor 18.

The framework for the roll over conveyor 18 is fixedly mounted on top of the table and scrap conveyor support frame 38 as shown in FIGS. 1, 3 and 4. More specifically, a pair of input mount brackets 134 (FIGS. 3 and 4) is rigidly affixed to the outside surfaces of and at the bottom of the pair of outer input risers 130R and 130L. The bottom flange of each of the pair of input mount brackets 134 rests upon one of a pair of mount pads 138 and is fixedly attached to the top surface of one of the pair of top stringers 48R and 48L by means of a set of bolts 140 that pass through the associated mount pad 138. The pair of input mount brackets 134 is located adjacent to the short turnover lateral mount 70. Each of a pair of output mount brackets 136 is rigidly affixed to the outside surfaces of and at the bottom of one of the pair of center output risers 110. The bottom flange of each of the pair of output mount brackets 136 rests upon a mount pad 142 which is fixedly attached to the top surface of the center turnover lateral mount 72. A set of bolts 144 attach each bracket 136 to the associated mount pad 142.

Secondary structures that apply to either the pair of center turnover conveyors 34 or the pair of short turnover conveyors 36 or both will be described herein. As can be seen in FIGS. 2 and 3, each of a pair of outside output arms 146 is rigidly affixed at its output end to the front narrow face of one of the pair of outer input risers 130R and 130L, and in similar manner, each of a pair of inside output arms 148 is rigidly affixed to one of the pair of center input risers 112 to form a pair of holding brackets for the output end of the pair of short turnover conveyors 36. Referring again to FIG. 3, each of a pair of center conveyor input arms 150R and 150L is rigidly affixed at its output end to the front narrow face of one of the pair of center input risers 112 and in longitudinal line with one of the pair of center conveyor input members 116 and 116L. The pair of center conveyor input arms 150R and 150L form a holding bracket for the input end of the pair of center turnover conveyors 34. Each of a pair of short input arms 152R and 152L is rigidly affixed at its output end to the front narrow face of one of the pair of outer input risers 130R and 130L and in parallel alignment with the pair of center conveyor input arms 150R and 150L to form a pair of input brackets for the pair of short turnover conveyors 36.

The structure of the pair of vertical main hoppers 28 and associated structures is similar to that described in copending application Ser. No. 258,180, filed May 31, 1972, of Kenneth R. Runyan et al., and will not be discussed in detail herein. A schematic outline of the framework of the pair of vertical hoppers 28 is shown in FIGS. 1 and 2 to indicate the placement thereof with respect to the quadruple stacker 10. Fragmentary portions of the vertical main hopper 28 are shown in FIGS. 16, 17, 20, 24 and 25.

The Pick-off Sections

Figure 5:
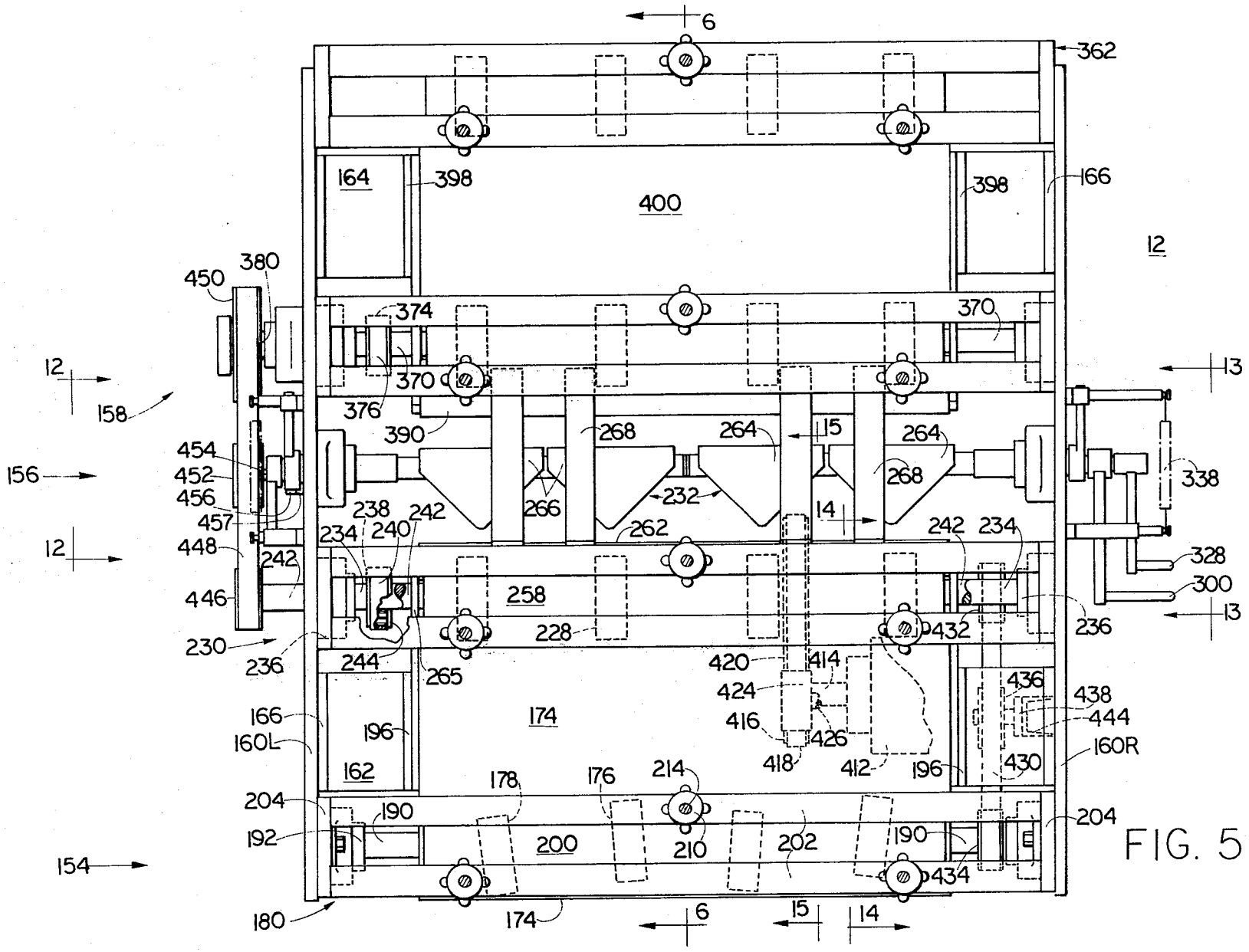
FIG. 5 is an enlarged plan view of a pickoff section of the machine.
Figure 6:
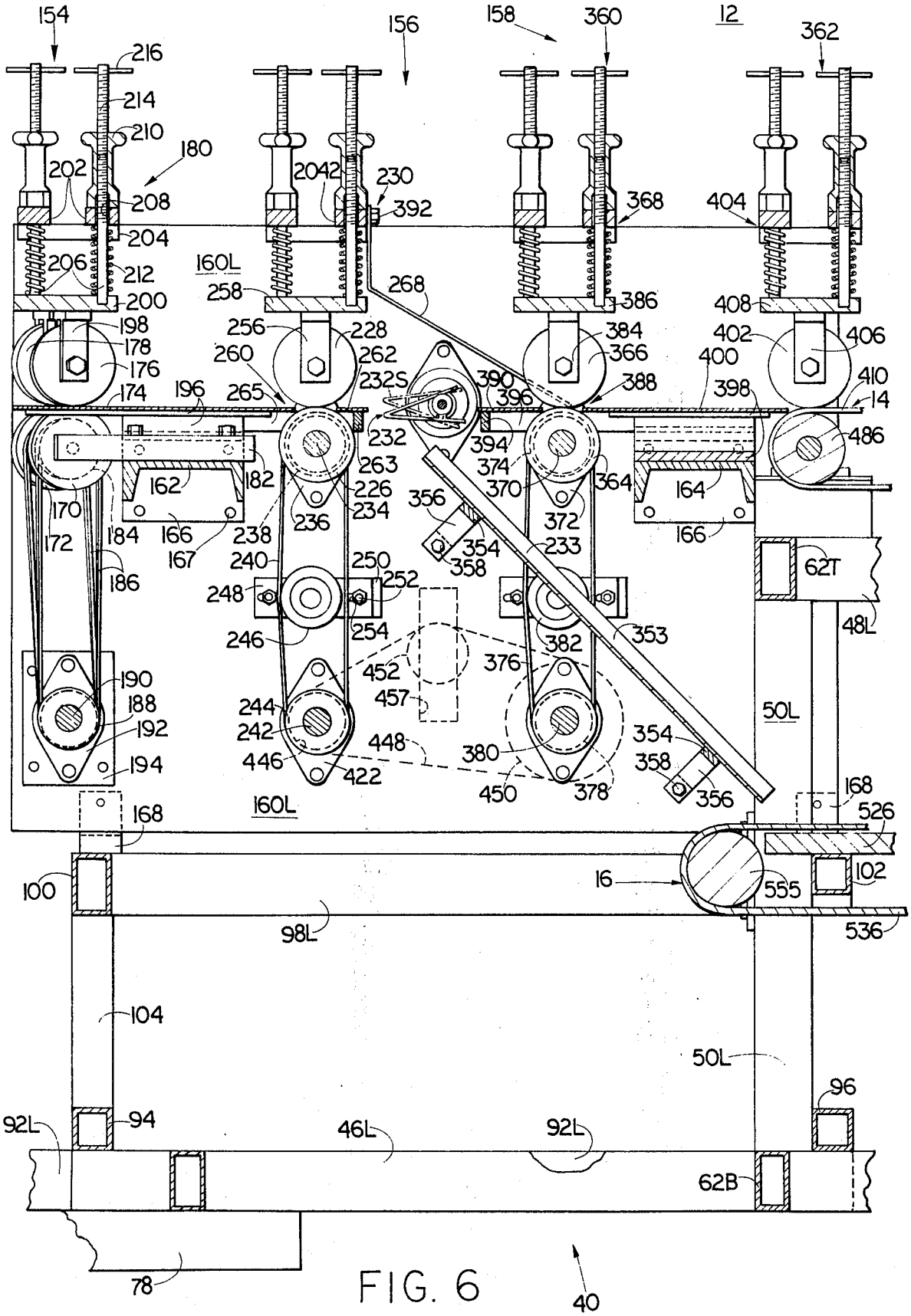
FIG. 6 is a view in section taken generally on the line 6—6 in FIG. 5.
Figure 6:
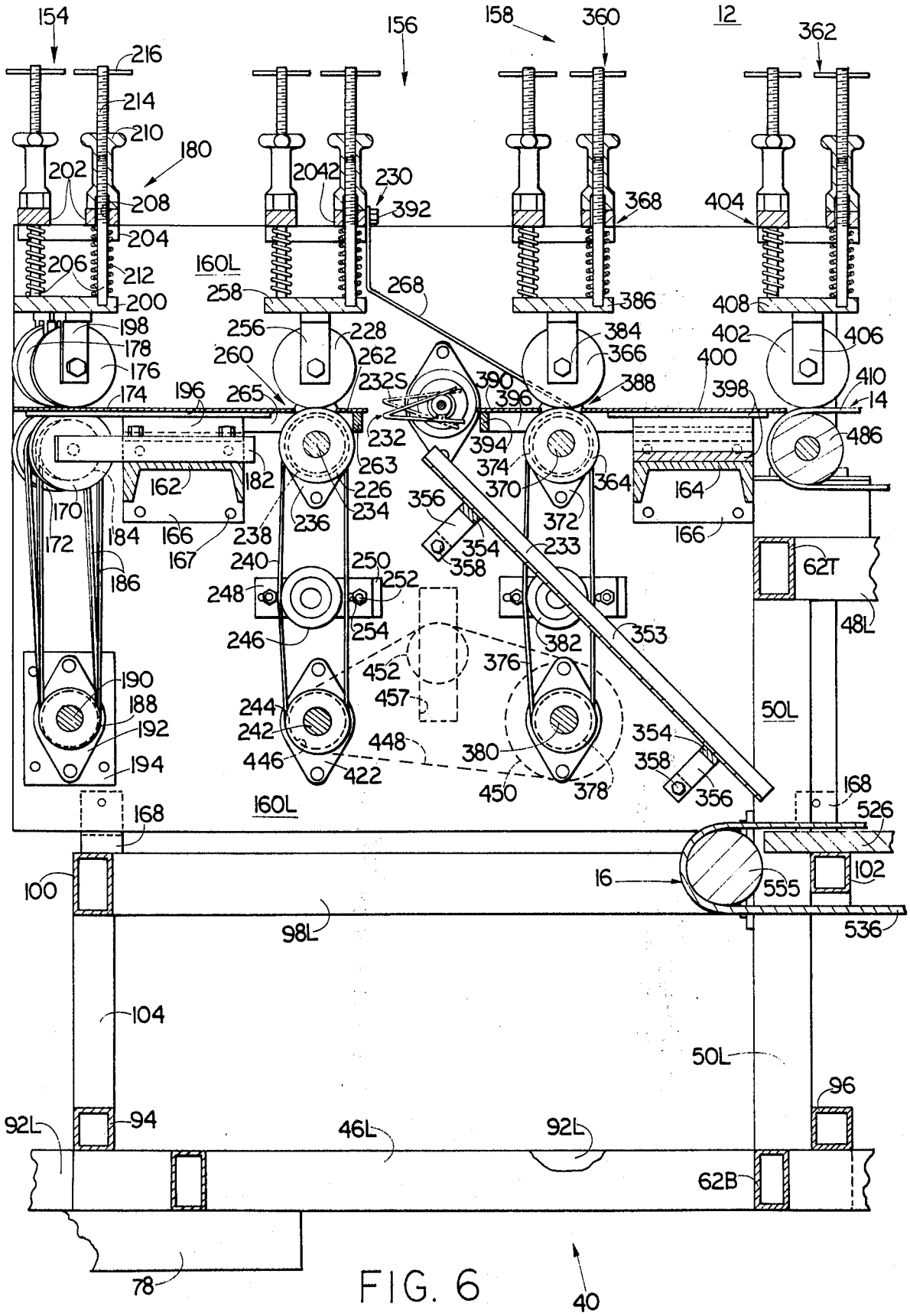

The pick-off section 12, as shown in FIGS. 5 and 6, is comprised of a separator assembly 154, a diverter assembly 156, and a shingler assembly 158. The separator assembly 154 is fixedly attached between a pair of side plates 160R and 160L as is the diverter assembly 156 and the shingler assembly 158. The pair of side plates 160R and 160L is fixedly held in vertical and lateral spaced relationship with each other by means of a separator roll support 162 and a shingler roll support 164. The separator roll support 162 and the shingler roll support 164 are channel beams. Each of the roll supports 162 and 164 incorporates mount plates 166 rigidly affixed to the ends thereof. The mount plates 166 are attached to the side plates 160R and 160L by fasteners 167 (FIG. 6). The pickoff section 12 is fixedly attached to the pick-off mount frame 40 by means of a set of four mount brackets 168 as can be seen in FIGS. 2 and 6.

Figure 21:
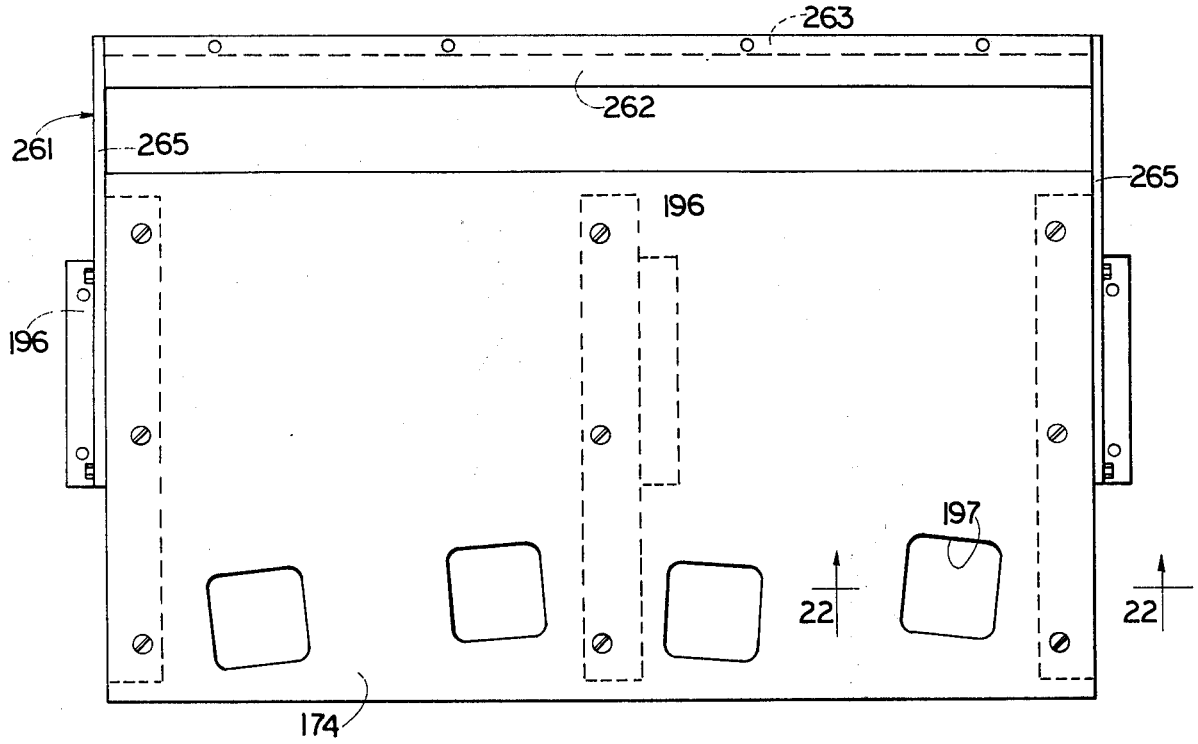
FIG. 21 is a plan view of a pair of transfer plates of the machine and supports therefor.
Figure 22:
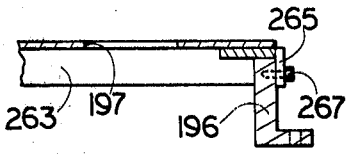
FIG. 22 is a view in section taken on the line 22—22 in FIG. 21.

The separator assembly 154 is comprised of a pair of inner pick-off rolls 170 (see FIG. 6), a pair of outer pick-off rolls 172, a traverse plate 174, a pair of inner upper rollers 176, a pair of outer upper rollers 178 and a roller pressure assembly 180. Each of the pair of inner pick-off rolls 170 and each of the pair of outer pick-off rolls 172 is rotatably mounted to a roller bracket 182 that is in turn cantilever mounted from the top surface of the separator roll support 162. Also, each pick-off roll incorporates a timing pulley 184, and each timing pulley cooperates with a timing belt 186 that receives power from a respective timing drive pulley of a set of four timing drive pulleys 188. The set of four timing drive pulleys 188 is fixedly attached to a drive shaft 190 that is rotatably mounted in a pair of bearings 192. Each of the bearings 192 is in turn fixedly attached to one of the pair of side plates 160R and 160L through a spacer block 194. Power input to the drive shaft 190 will be described hereinafter. Continuing with FIG. 6, the traverse plate 174 is fixedly attached to a set of three mounting brackets 196, each of which is in turn fixedly attached to the top surface of the separator roll support 162. FIG. 6 is a centerline section of the pickoff machine 12 except for the exclusion of the center mounting bracket of the set of three mounting brackets 196 to give a clear view of the roller bracket 182. The traverse plate 174 incorporates a set of four rectangular openings 197 (FIGS. 21 and 22) sufficient enough in dimension to permit the unobstructed contact between the pair of inner upper rollers 176 (FIG. 6) and the pair of inner pick-off rolls 170, and the pair of outer upper rollers 178 and the pair of outer pick-off rolls 172. The inner upper rollers 176 and the outer upper rollers 178 are each rotatably held in one of a set of four mounting yokes 198 that is in turn fixedly attached to a pressure plate 200. The pair of inner upper rollers 176 and the pair of outer upper rollers 178 receive motive power from their corresponding pick-off rolls. The pressure plate 200 is a part of the roller pressure assembly 180.

The roller pressure assembly 180 comprises a pair of pressure bars 202 rigidly affixed in parallel lateral alignment with each other by means of a pair of end mounts 204, the pair of end mounts 204 being fixedly attached to the inner surfaces of the pair of side plates 160R and 160L as shown in FIGS. 5 and 6. The pressure plate 200 incorporates a vertical degree of freedom with respect to the pair of pressure bars 202 by means of a set of three vertical slide pins 206 mounted in the pressure plate 200. The set of three vertical slide pins 206 pass through a corresponding set of three slide holes 208 arranged in a triangular manner in the pair of pressure bars 202, one of which is shown in FIG. 6. The pressure plate 200 is forced downwardly with respect to the pair of pressure bars 202 by means of a set of three springs 212 mounted therebetween and each coaxially mounted on one of the set of three vertical slide pins 206. The top portion of each of the set of three slide pins 206 incorporates a threaded length that cooperates with one of a set of three adjusting knobs 210, to provide a means for setting no load pressure position of the pressure plate 200. Each of the adjusting knobs 210 bears against the top surface of one of the pair of pressure bars 202 and is free to move vertically away from that surface when the pressure plate 200 is forced upward. Each of the knobs 210 is retained in fixed relationship with respect to the associated slide pins 206 by means of a locking pin 214 that loads the threads of the locking knob 210 against the threads of the associated slide pin 206. A locking handle 216 is provided through the upper end of each of the locking pins 214 to provide hand adjustment thereof.

The function of the separator assembly 154 can best be described by referring to FIG. 7. As was previously described with the use of FIG. 1, the set of scoring and cutting rolls 22 (FIG. 1) provides the pick-off machine 12 with quadruple streams of cartons 24. An inner two rows of cartons 218 (FIG. 7) emerge from the set of scoring and cutting rolls 22 in a tab interlock manner, although the cartons are completely separated. An outer two rows of cartons 220 are slightly separated from the inner two rows of cartons 218 in a line to line fashion, i.e., the outer envelope of adjacent cartons lay on a common line, thus fractionally interfering. Handling and stacking of interfering cartons is difficult. The function of the separator assembly 154 is to longitudinally and laterally separate the quadruple stream of cartons 24 simultaneously. The pair of inner upper rollers 176 and the pair of inner pick-off rolls 170 comprises a pair of inner separator roll assemblies 222, and likewise the pair of outer upper rollers 178 and the pair of outer pick-off rolls 172 comprise a pair of outer separator roll assemblies 224. Each separator roll of the pairs of inner separator rolls 222 and the outer separator rolls 224 is longitudinally staggered to cooperate with the leading edges of the quadruple streams of cartons 24. The pairs of inner separator roll assemblies 222 and the outer separator roll assemblies 224 run at a speed slightly higher than that of the delivery speed of the set of scoring and cutting rolls 22. As the quadruple streams of cartons 24 make contact with the separator assembly 154. The speed of the streams increases, consequently separating each carton's trailing edge from its successor's leading edge. The rolls of the pair of inner separator roll assemblies 222 are opposedly canted to sufficiently separate laterally the inner two rows of cartons 218, and the rolls of the pair of outer separator roll assemblies 224 are similarly angled to sufficiently separate laterally the outer two rows of cartons 220 from their adjacent inner rows of cartons 218. The cartons do not lose their individual longitudinal orientation, but simply move sideways or laterally. As the cartons exit the separator assembly 154, they enter the diverter assembly 156.

The diverter assembly 156, shown in FIGS. 5 and 6, is comprised of a set of four lower rolls 226, one of which is shown in FIG. 6, a set of four upper idlers 228, each of which overlies one of the lower rolls 226, a second pressure assembly 230, a diverter 232 and a scrap chute 233.

The set of four lower rolls 226 is fixedly attached to a roll shaft 234 that is rotatably mounted in a pair of bearings 236. Each of the bearings 236 is fixedly attached to one of the pair of side panels 160R and 160L. A drive pulley 238 is fixedly attached to the left side of the roll shaft 234 (FIG. 5) and cooperates with a vertical timing belt 240 that transfers power from a lower drive pulley 244 that is fixedly attached to a main drive shaft 242. A tension pulley 246 (FIG. 6) is rotatably mounted to an idler block 248 that is slidably mounted to a side panel block 250 by means of a pair of bolts 252 that cooperate with a pair of longitudinal slots 254. The side panel block 250 is fixedly attached to the left side panel 160L.

Each idler of the set of four upper idlers 228 is rotatably mounted in a yoke bracket 256 that is fixedly attached to a second pressure plate 258. The second pressure plate 258 is part of the second pressure assembly 230. The second pressure assembly 230 is similar in construction and mounting to that of the roller pressure assembly 180. The set of four upper idlers 228 and the set of four lower rollers 226 cooperate in opposition to each other to form a set of four straightening roll assemblies 260 that receive cartons from the separator assembly 154. Immediately upon entering the set of four straightening roll assemblies 260, the individual cartons of the quadruple stream of cartons 24 cease their lateral movement and reassume purely longitudinal movement. The set of four straightening roll assemblies 260 run at the same speed as the pairs of inner and outer separator roll assemblies 222 and 224.

The set of four straightening roll assemblies 260 deliver the quadruple stream of cartons 24 across a second traverse plate 262 and into the diverter 232 without changing the longitudinal distance between each carton as is shown in FIG. 8. Referring again to FIG. 6, the second traverse plate 262 is held in fixed relationship to the traverse plate 174 by means of a generally U-shaped support 261 (FIG. 21) which includes a transverse bar 263 and a pair of longitudinal arms 265 attached to ends of the bar 263 and extending toward the input end of the pick-off machine 12, to be attached to the outside surfaces of the outside ones of the set of three mounting brackets 196 by fasteners 267.

The diverter 232 comprises a pair of right side diverter blades 264 and a pair of left side diverter blades 266 as are shown in FIG. 5. The diverter 232 is shown in full lines in FIG. 6 and in FIG. 8 in a normal operating mode. In this position the operator has elected to permit the quadruple streams of cartons 24 to flow over the diverter assembly 156 and through the shingler assembly 158, the table conveyor 14, the rollover conveyor 18 (FIG. 2), the set of four cross conveyors 20, and into the pair of vertical hoppers 28. In so doing the quadruple set of cartons 24 bend upwardly as shown in FIG. 8 and slidably pass over the stop surfaces of the pairs of right and left side diverter members 264 and 266 with leading edges of the cartons 24 subsequently impacting a set of four deflector tongues 268 (FIG. 6).

This is the entrance to the shingler assembly 158 and will be described in detail hereinafter.

The diverter 232 is shown in FIG. 6 in dot-dash lines to indicate the position of the diverter 232S in its scrapping mode. In this mode the operator has elected to deflect the quadruple streams of cartons 24 downwardly into the scrap chute 233 and onto the scrap conveyor 16. This function is more clearly indicated in FIG. 9. As the quadruple streams of cartons 24 pass through the set of four straightening rolls 260, their leading edges slidably pass across the bottom surfaces of the pairs of right and left side diverter members 264 and 266 respectively, their leading edges being forced downwardly to turn the quadruple stream of cartons 24 into the scrap chute 233. In this manner, cartons are deflected to the scrap conveyor 16 (FIG. 6) for removal from the quadruple stacker 10.

Figures 10, 10A, 11, 12, 13:
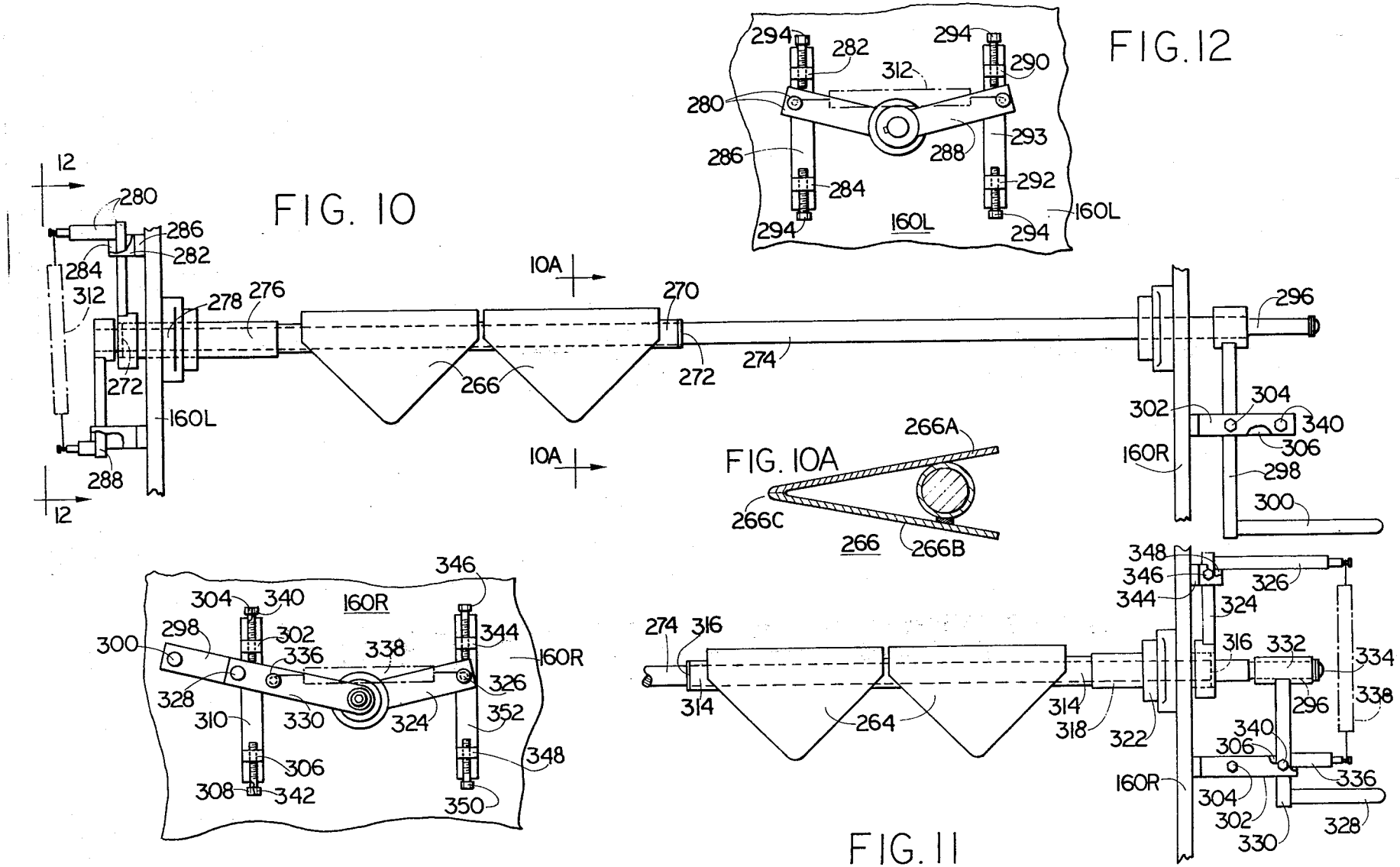
FIG. 10 is an enlarged fragmentary plan view of a left half of the discriminator assembly of the pickoff section of the machine.
FIG. 10A is a view in section taken on the line 10A—10A in FIG. 10.
FIG. 11 is an enlarged fragmentary view of a right half of the discriminator assembly of the pickoff section of the machine.
FIG. 12 is an enlarged fragmentary view in left side elevation of remote operator handles of the diverter assembly, taken in the direction of the arrows 12—12 in FIG. 5.
FIG. 13 is an enlarged fragmentary view in right side elevation of operator handles of the diverter assembly, taken in the direction of the arrows 13—13 in FIG. 5.

The pair of right side diverter members 264 can be actuated to the scrap mode independently of the pair of left side diverter blades 266, and in a similar manner the pair of left side diverter blades 266 can be actuated to the scrap mode independently of the pair of right side diverter blades 264 as can be seen in FIGS. 10 and 11. The purpose for deflecting either the right hand, the left hand, or both pairs of carton rows of quadruple stream of cartons 24 to the scrapping mode is twofold. First, cartons being delivered to the pick-off machine 12 from the set of scoring and cutting rolls 22 may be of inferior quality, thus requiring rejection from further processing. Second, the normal operating mode of the quadruple stacker 10 may be operating unsatisfactorily, at which time the operator may wish to deflect acceptable cartons to the scrap conveyor 16 for processing (stacking) by hand, thus continuing limited production while the quadruple stacker is serviced.

With reference to FIG. 10, the pair of left side diverter members 266 is fixedly attached to a left side diverter tube 270. As shown in FIG. 10A, each diverter member 266 includes an upper plate 266A, and a lower plate 266B which meet at an edge 266C. A pair of bushings 272 (FIG. 10) is frictionally inserted into the ends of the left side diverter tube 270. The left side diverter tube 270 is coaxially and rotatably mounted on a diverter shaft 274 by means of the pair of bushings 272. A left side diverter tube sleeve 276 is fixedly attached over the left end of the left side diverter tube 270 and is rotatably mounted through a left side diverter bearing 278. The left side diverter tube 270 and the left side diverter tube sleeve 276 extend slightly beyond the left hand side panel 160L to carry a left side diverter tube crank arm 280 fixedly attached thereto. As can be seen in FIG. 12, the left side diverter tube crank arm 280 rotates clockwise until it is restrained by a diverter tube arm shingle stop 282. In a similar manner the left side diverter tube arm 280 rotates counterclockwise until it is restrained by a diverter tube arm scrap stop 284. The diverter tube arm shingle stop 282 and the diverter tube arm scrap stop 284 are carried by a stop mount 286 that is fixedly attached to the outer surface of the left hand side plate 160L. As can be seen in FIG. 10, the diverter shaft 274 extends laterally and slightly beyond the left end of the left side diverter tube sleeve 276 to incorporate a diverter shaft arm 288 that is fixedly attached thereto. Referring again to FIG. 12, the diverter shaft arm 288 rotates counterclockwise until it is restrained by a diverter shaft arm shingle stop 290 and, in similar manner, it rotates clockwise until it is restrained by a diverter shaft arm scrap stop 292. The diverter shaft arm shingle stop 290 and the diverter shaft arm scrap stop 292 are fixedly attached perpendicularly to and near the ends of a stop mount 293 that is in turn rigidly affixed to the outside surface of the left hand side plate 160L. A set of four bolts 294 is threadably mounted through the ends of the diverter tube arm shingle stop and the scrap stop 282 and 284, respectively, as well as the diverter shaft arm shingle stop 290 and scrap stop 292 to provide rotational adjustment to the left side diverter tube arm 280 and the diverter shaft arm 288. Referring again to FIG. 10, the right end of the diverter shaft 274 incorporates a short spindle 296 that is smaller in diameter than the remainder of the shaft. Just inboard of this short spindle 296 is a left side diverter arm 298 that is fixedly attached by means of a key (not shown) to the diverter shaft 274. A left side diverter handle 300 is fixedly attached to the free extremity of the left side diverter arm 298. Referring to FIGS. 10 and 13, the left side diverter arm 298 is limited in its clockwise rotation by a diverter arm shingle stop 302 that is threadably fitted with a left side shingle stop bolt 304. The left side diverter arm 298 is limited in counterclockwise rotation by means of a diverter arm scrap stop 306 that is threadably fitted with a left side scrap stop bolt 308. The diverter arm shingle stop 302 and the diverter arm scrap stop 306 are fixedly and perpendicularly attached near the ends of a stop mount 310 that is in turn fixedly attached to the outside surface of the right hand side plate 160R.

With reference to FIG. 13, the left side diverter handle 300 is normally in the up position, that is, with the left side diverter arm 298 resting against the left side shingle stop bolt 304. If the two left side streams of cartons of the quadruple streams of cartons 24 are to be transferred to the scrap conveyor 16, then the operator will depress the left side diverter handle 300 downwardly until the left side diverter arm 298 comes to rest against the left side scrap stop bolt 308. This rotates the diverter shaft 274 counterclockwise with respect to FIG. 13 and clockwise with respect to FIG. 12. The diverter shaft arm 288 consequently rotates clockwise (FIG. 12) and comes to rest against the bolt 294 of the diverter shaft arm scrap stop 292. The free end of the diverter shaft arm 288 is connected to the free end of the left side diverter tube arm 280 by means of a left side tension spring 312. As the diverter shaft arm 288 rotates clockwise in FIG. 12, the left side spring 312 expands and rotates into parallel alignment with the left side diverter tube arm 280. As the diverter shaft arm 288 rotates further, the left side spring 312 passes the point of parallel alignment and subsequently contracts quickly, literally snapping the left side diverter tube arm 280 from the diverter tube arm shingle stop 282 to the diverter tube arm scrap stop 284. The action of the left side spring 312 rapidly changes the pair of left side diverter blades 266 from its shingle position to its scrap position. The rapidity of change must occur within the time of one card passing over the diverter 232. This minimizes the chance of stopping a card with either nose of the pair of left side diverter members 264 which would subsequently disrupt the flow of the quadruple streams of cartons 24 through the diverter assembly 156.

The pair of right side diverter members 264, see FIG. 11, is fixedly attached to a right side diverter tube 314 that incorporates a pair of bushings 316 frictionally inserted into the ends thereof. The right side diverter tube 314 is coaxially and rotatably mounted on the diverter shaft 274 by means of the pair of bushings 316. The right end of the right side diverter tube 314 is fixedly fitted with a sleeve 318 that is in turn rotatably mounted through a right side diverter bearing 322. The sleeve 318 passes laterally beyond the right hand side plate 160R and fixedly incorporates a right side sleeve arm 324. The free extremity of the right side sleeve arm 324 is fixedly fitted with a right side sleeve handle 326. A right side diverter handle 328 is fixedly attached to a right side diverter arm 330 that is in turn rigidly affixed to a handle sleeve 332. The handle sleeve 332 is rotatably held on the short spindle 296 by means of a bolt and washer assembly 334. The right side diverter arm 330 also incorporates a spring spindle 336 fixedly attached thereto, to cooperate with a right side spring 338 that connects the sleeve handle 326 to the right side diverter arm 330. Referring to FIG. 13, the right side diverter arm 330 is limited in clockwise rotation by means of a right side diverter handle shingle stop bolt 340 and is limited in counterclockwise rotation by means of a right side diverter handle scrap stop bolt 342. The right side diverter handle shingle stop bolt 340 and scrap stop bolt 342 are threadably mounted through the outer ends of the diverter arm shingle stop 302 and the diverter arm scrap stop 306 respectively. The right side sleeve arm 324 is limited in counterclockwise rotation by means of a right side sleeve shingle stop 344 that incorporates an adjusting bolt 346, and is similarly limited in clockwise rotation by means of a right side sleeve scrap stop 348 that also incorporates an adjusting bolt 350. The right side sleeve handle shingle stop 344 and the scrap stop 348 are fixedly and perpendicularly attached near the ends of a mount bracket 352 (FIG. 13) that is in turn rigidly affixed to the right hand side plate 160R.

As the right side diverter handle 328 is rotated counterclockwise from the right side diverter handle shingle stop bolt 340 toward the right side diverter handle scrap stop bolt 342, the right side spring 338 is elongated and rotates with respect to the right side sleeve handle 326 into parallel alignment with the right side sleeve arm 324. As the right side spring 338 rotates past the line of parallel alignment with the right side sleeve arm 324, the right side spring 338 contracts to rapidly rotate the right side sleeve arm 324 from the right side sleeve shingle stop 344 to the right side sleeve scrap stop 348. The pair of right side diverter members 264, being rigidly affixed to the right side sleeve handle 326, likewise rapidly changes from its shingle position to its scrap position. This rapid change of position prevents the operator from jamming the quadruple stream of cartons 24 that otherwise could occur if the transfer were made too slowly as has been previously described. The change in position from the scrap position to the shingle position is a simple reverse of the aforedescribed procedure. The composite right and left hand system is shown in FIG. 5.

The scrap chute 233, as shown in FIG. 6, is essentially a simple metal plate with turned up sides 353. The scrap chute 233 is fixedly attached within the confines of the pickoff machine 12 by means of a pair of lateral mount bars 354. Each of the pair of lateral mount bars 354 incorporates a pair of perpendicular mounted 356 rigidly affixed to the ends thereof, and fixedly attached to the inner surfaces of the pair of side plates 160R and 160L by means of a set of bolts 358. The scrap chute 233 occupies such a position as to facilitate the flow of cartons from the bottom surface of the diverter 232S to the scrap conveyor 16. As the cartons make contact with the scrap chute 233, friction slows their speed, thus permitting each succeeding carton to fall overlapped on top of its forerunner.

The shingler assembly 158 is comprised of a lap roll assembly 360 and a shingle roll assembly 362 as shown in FIG. 6. The lap roll assembly 360 comprises a set of four lower lap rolls 364, a set of four lap idlers 366, a third pressure assembly 368, and the set of four deflector tongues 268. The set of four lower lap rolls 364 is fixedly attached to a second roll shaft 370 that is rotatably mounted in a pair of bearings 372 that are in turn fixedly attached to the pair of side panels 160R and 160L. A second drive pulley 374 is fixedly attached to the left side of the second roll shaft 370 (FIG. 5) and cooperates with a second vertical timing belt 376 that transfers power from a second lower drive pulley 378 that is fixedly attached to a second main drive shaft 380. A second tension pulley 382 is rotatably mounted in a similar manner as the tension pulley 246 of the diverter assembly 156. Each idler of the set of four upper lap idlers 366 is rotatably mounted in a yoke bracket 384 that is fixedly attached to a third pressure plate 386. The third pressure plate 386 is part of the third pressure assembly 368. The third pressure assembly 368 is similar in construction and mounting to that of the roller pressure assembly 180. The set of four upper lap idlers 366 and the set of four lower lap rolls 364 cooperate in opposition to each other to form a set of four lapping roll assemblies 388 that receive cartons from the diverter assembly 156 when the diverter 232 is in its normal processing position as shown by the solid lines in FIG. 6. The quadruple streams of cartons 24 are guided into the set of four lapping roll assemblies 388 by means of the set of four deflector tongues 268 and a third transverse plate 390. Each of the set of four deflector tongues 268 is fixedly mounted at its input end to the output face of an upper pressure bar 2042 of the pair of pressure bars of the second pressure assembly 230 by means of one of a set of four bolts 392. The deflector tongues 268 extend diagonally downward at their output ends, the output ends resting alongside their respective upper lap idler 366. The third transverse plate 390 is rigidly held in the same horizontal plane as the traverse plate 174 and the second traverse plate 262 by means of a traverse plate lateral bracket 294. The traverse plate lateral bracket 394 is fixedly attached at its ends to a pair of cantilever braces 396. The braces 396 are in turn rigidly affixed to the outside members of a set of three plate mounts 398, only two of which are shown. The set of three plate mounts 398 is fixedly attached to the top surface of the shingler roll support 164. The three plate mounts 398 basically function as a mounting bracket for a fourth traverse plate 400 that guides the quadruple streams of cartons 24 out of the lap roll assembly 360 and into the shingle roll assembly 362.

In normal operation the quadruple streams of cartons 24 pass upwardly and over the top surface of the diverter 232 as is shown in FIG. 8. The leading edge of each carton therefore extends upwardly and forwardly until contact is made with the lower surface of one of the set of four deflector tongues 268. As the cartons are about to enter the lapping roll assemblies 388, their trailing edges are released by the set of four straightening roll assemblies 260, thereby permitting the trailing edge of each carton to pop up and straighten each carton. The longitudinal speed of each carton is decreased upon entry into the set of four lapping roll assemblies 388, since the set of four lapping roll assemblies 388 is driven at a speed slightly less than that of the set of scoring and cutting rolls 22 and therefore slower than the set of four straightening roll assemblies 260. As a result of slowing the quadruple streams of cartons 24, the leading edges of succeeding cartons moving through the set of four straightening rolls 260 slide up the top surface of the diverter 232 and under the trailing edge of the preceding carton, thereby tucking each succeeding carton under the trailing edge of its predecessor, as can be seen in FIGS. 7 and 8.

Referring again to FIG. 6, the shingle roll assembly 362 is comprised of a set of four shingle idlers 402, a fourth pressure assembly 404 and the input end of the table conveyor 14. Each idler of the set of four shingle idlers 402 is rotatably mounted in a yoke bracket 406 that is in turn fixedly attached to the bottom surface of a fourth pressure plate 408. The fourth pressure plate 408 is an integral part of the fourth pressure assembly 404, the forth pressure assembly 404 being of similar construction and mounting as that of the roller pressure assembly 180. Each of the set of four shingle idlers 402 presses against the surface of one of a set of four table conveyor belts 410 of the table conveyor 14 and receives power therefrom. The construction and mounting of the table conveyor 14 will be described hereinafter.

The shingle roll assembly 362 is driven at the table conveyor speed, which is appropriately slower than the speed of the set of four lapping rolls 388. As the quadruple streams of cartons 24 enter the shingle roll assembly 362, their longitudinal speed is again reduced to form a rather close shingle or overlap of each of the rows of cartons of the quadruple set of cartons 24 as can be seen in FIG. 7.

Pick-off Machine Power Distribution

Power is distributed throughout the pickoff machine 12 in the following manner. Referring to FIGS. 5, 6, 14, and 15, a shaft 411 drives a gear box shaft 4111 (FIG. 14) to drive gearing (not shown) in a gear box 412. The shaft 411 is driven by a sprocket 4121 (FIG. 1) and a drive chain 4122. The chain 4122 is driven by mechanism (not shown) in the press 23 (not shown in detail) which also drives the cutting rolls 22 so that the gearing in the gear box 412 is driven in timed relation to the cutting rolls 22. The gear box 412 delivers power through a gear box shaft 414 (FIG. 14) to a gear box pulley 416 as shown in FIG. 15. The gear box pulley 416 is a timing pulley that cooperates with a timing drive belt 418 that circumscribes a main drive shaft pulley 420. The main drive shaft pulley 420 is fixedly attached to the right side of the main drive shaft 242 that is in turn rotatably mounted in a pair of main shaft bearings 422, one of which is shown in FIG. 6. The pair of main shaft bearings 422 are fixedly attached to the inside surfaces of the pair of side plates 160R and 160L. In this manner power is transferred to the main drive shaft 242. A drive idler 424 (FIGS. 5 and 15) is rotatably mounted by means of an idler shaft 426 rotatably mounted on a slide block 427 adjustably attached to an idler mount 428 (FIG. 15). The idler mount 428 is rigidly affixed in a cantilever manner to the output face of the input lateral top member 100. The drive idler 424 provides tension in the timing drive belt 418.

Power is taken from the right side of the main drive shaft 242 and transferred to the drive shaft 190 (FIGS. 5 and 14) by means of a horizontal drive timing belt 430. The horizontal drive timing belt 430 circumscribes a right side power takeoff pulley 432 that is fixedly attached to the main drive shaft 242, and a drive shaft pulley 434 that is fixedly attached to the drive shaft 190. Tension in the horizontal drive timing belt 430 is maintained by an idle pulley 436 that is rotatably mounted to a slide block 438 (FIG. 14) that incorporates a vertical degree of adjustment by means of a pair of slots 440 that cooperate with a pair of bolts 442 threadably mounted in a base block 444 that is in turn rigidly affixed to the inside surface of the right hand side plate 160R. By viture of the appropriate speed ratios that are built into the aforementioned pulleys, the drive shaft 190 and consequently the pair of inner separator roll assemblies 222 (FIG. 7) and the pair of outer separator roll assemblies 224 operate at a speed slightly higher than that of the set of scoring and cutting rolls 22 as has been previously described.

Power is taken from the left side of the main drive shaft 242 (FIGS. 5 and 6) by means of the lower drive pulley 244 to power the set of four straightening roll assemblies 260 at the same speed as the rolls of the separator assembly 154, as has been previously described.

Continuing with FIGS. 5 and 6, the main drive shaft 242 and the second main drive shaft 380 are rotatably held in their respective bearings, but also extend laterally to the left through and beyond the left side bearings and the left hand side plate 160L to provide appropriate shaft length for coupling the two shafts together. More specifically, the left end of the main drive shaft 242 is fixedly fitted with a power takeoff drive pulley 446 that cooperates with a lap roll timing drive belt 448 to transfer power to a lap drive pulley 450 that is fixedly attached to the left end of the second main drive shaft 380. Tension in the lap roll timing drive belt 448 is provided by an idler pulley 452 that is rotatably mounted on a shaft 454 that is in turn fixedly mounted to an adjusting block 456 which is adjustably mounted on a mount block 457. The mount block 457 is rigidly affixed to the outside surface of the left hand side panel 160L. In this manner power is transferred from the main drive shaft 242 to the second main drive shaft 380 by means of the large diameter lap drive pulley 450 to provide a reduced speed to the set of four lapping roll assembles 388 as has been previously described.

The rolls of the shingle roll assembly 362 receive power from the set of four table conveyor belts 410. In so doing, the rolls of the shingle roll assembly 362 are driven at a speed less than the set of four lapping roll assemblies 338 to produce the desired overlap of individual cartons of the quadruple streams of cartons 24 as has been previously described. The mechanical details and motive power specific to the set of four table conveyor belts 410 will be described in detail hereinafter.

The various rolls of the pickoff section 12 (FIG. 6) are thus driven in timed relation with the cutting rolls 22 (FIG. 1) of the printing press 23 (not shown in detail). The angled rolls 170 and 172 of the separator assembly 154 (FIG. 6) are driven at a peripheral speed of approximately 115% of the rate at which the cutting rolls deliver cartons to separate the cartons. The straightening rolls 226 are also driven at approximately 115% of the rate at which cartons are delivered by the cutting rolls 22 to advance the separated cartons longitudinally to the diverters 232. The lap rolls 364 are driven at a peripheral speed of approximately 62% of the speed at which the cartons are delivered by the cutting rolls 22 to cause the cartons to overlap in a shingle form as shown in FIG. 8. As will be explained in greater detail hereinafter, the belts 410 are advanced at a speed of approximately 25% of that at which the cutting rolls 22 deliver the cartons to cause the cartons to overlap in a closer shingle.

The Table Conveyor

The purpose of the conveyor table 14 is three-fold. The table conveyor 14 (FIG. 1) functions as a transport means for the quadruple streams of cartons 24, that is, the table conveyor 14 continuously moves the quadruple streams of cartons 24 from the output end of the pickoff machine 12 to the input end of the rollover conveyor 18. The length of the table conveyor 14 along with its speed of movement, allows sufficient time for the ink to dry on all cartons of the quadruple streams of cartons 24 before entering the rollover conveyor 18. Thirdly, the cartons travel printed side up over the table conveyor 14, and the table conveyor 14 functions as an inspection table to afford the operator an opportunity to judge the quality of the printed matter by inspection or removal, and to have an opportunity to remove damaged cartons that could cause a malfunction in subsequent operations of the quadruple stacker 10.

The table conveyor 14 incorporates a support table 456 as shown in FIGS. 1 and 2. The support table 456 is fixedly held in a horizontal plane by means of a pair of input mounts 458, a pair of middle mounts 460 and a pair of output mounts 462 that are rigidly affixed to the outside surfaces or edges of the support table 456 and the pair of top stringers 48R and 48L. The top of the support table 456 incorporates a middle rail 464 that functions as a barrier between the inner two rows of cartons 218 to insure that neither one of the inner two rows of cartons 218 is disturbed by the actions of an operator on the other row of cartons during an inspection or removal procedure. A pair of intermediate dividers 466 is fixedly attached in a longitudinal manner to the top of the support table 456. The pair of intermediate dividers 466 function as a barrier between the inner two rows of cartons 218 and the outer rows of cartons 220 in a similar manner and for similar reasons as that of the middle rail 464. The support table 456 also incorporates a pair of side fences 468 each of which is outwardly angled at its input end to prevent cartons of the outer rows of cartons 220 from spilling off the table conveyor 14 for any reason.

The table conveyor 14 incorporates the set of four table conveyor belts 410 as is shown in FIG. 1. The set of four table conveyor belts 410 passes in a clockwise direction around a drive roll 472 and receives motive power therefrom. The drive roll 472 is rotatably mounted in a pair of bearings (not shown) that is in turn fixedly attached to the inside surfaces of a pair of drive roll mounts 474, one of which is shown in FIG. 1. The pair of drive roll mounts 474 is fixedly attached to the outside surfaces of the pair of top stringers 48R and 48L, and approximate to the pair of conveyor output midposts 54. The set of four table conveyor belts 410 proceeds upwardly and toward the input end of the table conveyor 14 to pass over an idler roll 476. The idler roll 476 rotates in a counterclockwise direction with respect to FIG. 1 and is rotatably and adjustably held in lateral placement by means of an idler eyebolt assembly 477.

The idler eyebolt assembly 477, as shown in FIGS. 1A and 1B, is comprised of a lateral idler shaft 478 that incorporates a smaller diameter spindle 479 at each end thereof, a pair of eyebolts 480 and a pair of eyebolt mounts 481. The idler roll 476 is rotatably mounted on the lateral idler shaft 478. The smaller diameter spindles 479, an integral part of the lateral idler shaft 478, are each fixedly held within the inside diameter of the eye of one of the pair of eyebolts 480 by means of a set screw 483 that clamps the smaller diameter spindle 479 in the vertical and longitudinal direction for restraint thereof. The pair of eyebolts 480 is longitudinally adjustable through the flange of the pair of eyebolt mounts 481 in the following manner. The threaded shank of each of the pair of eyebolts 480 passes through a clearance hole in the flange of one of the pair of eyebolt mounts 481 and is fixedly attached therein by means of a pair of lock nuts 485. The pair of lock nuts 485 can be adjusted along the threaded shank of the pair of eyebolts 480, thereby longitudinally altering the position of the lateral idler shaft 478. This idler eyebolt assembly is repeatedly employed hereinafter and will not be discussed in further detail. The only alternation will be in the length of the lateral idler shaft 478 that will be apparent in the forthcoming description.

The idler eyebolt assembly 477 is rigidly affixed to the top surfaces of the pairs of top stringers 48R and 48L as shown in FIG. 1. The set of four table conveyor belts 410 passes horizontally toward the input end of the table conveyor 14 and each belt passes between a pair of guide pulleys 482. Each pair of guide pulleys 482 restrains the lateral displacement of its respective belt. Each pair of guide pulleys 482 is rotatably mounted in a guide pulley mount assembly 487 as is shown in FIGS. 1C and 1D.

The guide pulley mount assembly 487 incorporates a set of three lateral plates 489 rigidly affixed in longitudinal spaced relationship with each other atop a pair of vertical end mounts 491. Each of the vertical end mounts 491 is rigidly affixed to one of the pair of top stringers 48R and 48L (FIG. 1). Each of the pair of guide pulleys 482 is rotatably mounted on a shaft 493 (FIG. 1C) that incorporates a through hole for passage of an attachment bolt 495 that passes between one of a pair of slots 497 provided by the longitudinal displacement between the set of three lateral plates 489. A nut 499 fixedly attaches each guide pulley of the pairs of guide pulleys 482 at any lateral position along the slot 497.

The set of four table conveyor belts 410 then run in a clockwise direction around an input roller 486 that is rotatably mounted in a pair of input bearings 488. The pair of input bearings 488 is fixedly attached to a pair of input bearing blocks 490, one of which is shown in FIG. 1. The bearing blocks 490 in turn are each rigidly affixed at the input end and on top of one of the pair of top stringers 48R and 48L. The set of four table conveyor belts 410 leaves the input roller in a horizontal plane and slidably passes over the support table 456 to an output roller 492. The output roller 492 is rotatably held in lateral spaced relationship with the table conveyor 14 by means of a pair of output roller bearings 494, that is in turn fixedly attached on top of a pair of interface bearing blocks 496. The pair of interface bearing blocks 496 is rigidly affixed to the pair of top stringers 48R and 48L approximate to the top output lateral tube 68T. The set of four table conveyor belts 410 passes clockwise around the output roller 492 to again pass toward the input end of the table conveyor 14 and between a set of guide pulleys 498.

The set of guide pulleys 498 is rotatably mounted in a guide pulley mount assembly 501 that is similar in structure and mounting to that of the previously described guide pulley mount assembly 487.

The set of four table conveyor belts 410 then passes counterclockwise around a middle takeup roll 500. The middle takeup roll 500 is rotatably mounted in a pair of bearings 502 (see FIG. 1E) that is in turn fixedly attached in a longitudinally adjustable manner to the pair of top stringers 48R and 48L. The pair of bearings 502 is adjusted longitudinally by means of a pair of compression bolts 504 that forceably slide the pair of bearings 502 toward the input end of the table conveyor 14. Each of the pair of bearings 502 is locked in place by a pair of bearing bolts 505 that fit through longitudinal slots 507 in a pair of top plates 506 as well as through the top side of a pair of hollow mount tubes 508 that is affixedly attached thereto. The pair of hollow mount tubes 508 is rigidly affixed to the top of the pair of top stringers 48R and 48L. The set of four table conveyor belts 410 then returns to the drive roll 472 (FIG. 1) to complete the routing thereof.

Referring again to FIG. 1, power is delivered to the drive roll 472 by means of a drive sprocket 510 that cooperates with a table conveyor drive chain 512 that in turn takes power from a gear box sprocket 514. The gear box sprocket 514 is an integral part of a table conveyor gear box 518 that receives its motive power from a shaft 5181 which is driven by the gear box shaft 4111 (FIG. 15) and the shaft 411 so that the drive roll 472 and the belts 410 are driven in timed relation to the cutting rolls 22. Preferably the belts 410 advance at approximately 25% of the speed at which carton blanks are delivered by the cutting rolls 22. An idler sprocket 516 (FIG. 1) applies tension to the table conveyor drive chain 512 and is mounted atop the table conveyor gear box 518. The table conveyor gear box 518 is fixedly attached on top of the bottom output mid-lateral tube 66B.

The Scrap Conveyor

The scrap conveyor 16 receives overlapped cartons from the diverter section of the pickoff machine 12 by way of the scrap chute 233 (FIG. 6), and delivers the streams of cartons to the output end of the basic frame assembly 32 as shown in FIG. 1 for hand processing or disposal thereof. The scrap conveyor 16 incorporates a belt table 526 that is held in horizontal spaced relationship within the confines of the basic framework 32 by means of the pickoff output top lateral member 102, a second input lateral brace 528 (FIG. 1), a midlateral scrap brace 530, a turnover lateral scrap brace 532 and an output scrap brace 534. The second input lateral brace 528 is rigidly affixed between the pair of conveyor mid-posts 52, the mid-lateral scrap brace 530 is rigidly affixed between the pair of conveyor output mid-posts 54, the turnover lateral scrap brace 532 is rigidly affixed between the pair of short turnover posts 58, and the output scrap brace 534 is rigidly affixed between the pair of end posts 60R and 60L.

A scrap conveyor drive roll 520 is rotatably mounted in a pair of bearings (not shown) that is fixedly mounted to the inside surfaces of a pair of drive roll mount plates 522. The pair of drive roll mount plates 522 is fixedly attached to the outside surfaces of a pair of longitudinal lap mounts 524 that is in turn rigidly affixed between the pair of conveyor output mid-posts 54 and the pair of conveyor output posts 56 and in horizontal alignment with the mid-lateral scrap brace 530. A scrap conveyor belt 536 runs clockwise (with respect to FIG. 1) over the scrap conveyor drive roll 520 and into a horizontal plane toward the input end of the basic framework 32. The scrap conveyor belt 536 is a single belt that nearly spans the entire width of the basic framework 32.

The scrap conveyor belt 536 passes under a bottom idler and guiding pulley 538, up and over a second bottom idler and guiding pulley 540, and generally horizontally toward the front of the basic framework 32. The bottom idler and guiding pulley 538 is rotatably mounted between a pair of short vertical hangers 546, each of which is rigidly affixed at its top end to the outside surface of one of the pair of longitudinal lap mounts 524. The second idler and guiding pulley 540 is rotatably held on an idler bolt assembly 548 that provides vertical adjustment thereof. The idler eyebolt assembly 548 is similar to that of the idler eyebolt assembly 477 as previously described, except that it is mounted in a vertical manner upon the output faces of the pair of conveyor output mid-posts 54.

The scrap conveyor belt 536 is supported by a third idler and guiding pulley 542 that is rotatably held in lateral alignment by means of a third idler eyebolt assembly 552. The third idler eyebolt assembly 552 is fixedly attached in a horizontal disposition to the top surfaces of a pair of input scrap longitudinal mounts 554. Again the idler eyebolt assembly 552 is similar to that of the idler eyebolt assembly 477 (FIGS. 1A and 1B).

An input tapered pulley 555 (FIG. 1) is rotatably held in a pair of bearings 556 that is fixedly attached to the input faces of the pair of conveyor input posts 50R and 50L. The scrap conveyor belt 536 moves in a clockwise direction over the input tapered pulley 555 and passes horizontally over the length of the belt table 526 to the output end of the basic framework 32. As the output end of the basic framework 32 the scrap conveyor belt 536 again reverses direction around an output tapered scrap pulley 558. The output tapered scrap pulley 558 is rotatably mounted in a pair of scrap output bearings 560 that is fixedly attached to the output faces of the pair of end posts 60R and 60L.

The scrap conveyor belt 536 then passes through a set of three idler and guiding pulleys 562 rotatably mounted in a uniform manner between a pair of cantilever idler mounts 564. The cantilever idler mounts 564 are rigidly affixed at their input ends to the output surfaces of the pair of conveyor output posts 56. The scrap conveyor belt 536 passes over the first, under the second, and then over the third roller of the set of three idler and guiding pulleys 562. The scrap conveyor 536 then passes in a counterclockwise direction around a lap roller 566, before completing the cycle at the scrap conveyor drive roll 520. The lap roller 566 is rotatably mounted in a pair of bearings 568 fixedly attached to the bottom surfaces of the pair of longitudinal lap mounts 524.

The scrap conveyor drive roll 520 receives power by means of a sprocket 570 that is fixedly attached thereto. The sprocket 570 cooperates with a scrap conveyor chain 572 that in turn circumscribes a power takeoff sprocket 574 of a gear box 576. The gear box 576 is fixedly attached to the bottom output lateral tube 68B. A motor 578, fixedly attached to the gear box 576, supplies motive power thereto. An idler sprocket 580 is rotatably mounted at the input end of an idler sprocket mount 582. The idler sprocket mount 582 is fixedly attached on the inside surfaces of the right hand members of the pairs of conveyor output posts 56 and short turnover posts 58.

The Rollover Conveyors

The pair of center turnover conveyors 34, as shown in FIGS. 3 and 4, is comprised of the center turnover frame 42 and a pair of center turnover belts 584, supported and made mobile upon a series of pulleys and rollers to be described herein. The center turnover frame 42 has been described in detail along with the basic framework 32 and will be referred to where appropriate. The center turnover belts 584 extend in a clockwise direction (with respect to FIG. 3) around a center conveyor drive roll 586 that is fixedly attached to a center conveyor drive shaft 588 as is shown in FIG. 4. The center conveyor drive shaft 588 is rotatably mounted in a pair of bearings 590. The bearings 590 are in turn fixedly attached to inner faces of a pair of conveyor drive roll mounts 592. The conveyor drive roll mounts 592 are fixedly attached to the outside surfaces of the pair of top stringers 48R and 48L.

Referring again to FIG. 3, the center turnover belts 584 depart from the center conveyor drive roll 586 and proceed vertically upward to a pair of tapered idler rollers 594. Each of the pair of tapered idler rollers 594 is rotatably held by a pair of idler eyebolt assemblies 596, the outer mounting bracket of which is rigidly affixed in a horizontal disposition on the top edge of one of the pair of output mount brackets 136 and against the outside surfaces of one of the pair of center output risers 110. Each of the eyebolt assemblies 596 is similar in construction to that of the idler eyebolt assembly 477 that was previously described with reference to FIGS. 1A and 1B, except that an inner adjoining eyebolt mount 598 (FIG. 4) is somewhat wider to accommodate two eyeblts instead of one. The inner adjoining eyebolt mount 598 is fixedly attached in a cantilever manner to the center turnover lateral mount 72 by means of a block spacer 600. After passing around the pair of tapered idlers 594 in a counter clockwise direction (FIG. 3), the pair of center turnover belts 584 extends horizontally forward to pairs of guide pulleys 602.

The pair of guide pulleys 602 of each belt of the pair of center turnover belts 584 is fixedly attached in a guide pulley mount assembly 604 that is similar in construction to the guide pulley mount assembly 487 as was previously described with respect to FIGS. 1C and 1D. The guide pulleys 602 are mounted in an output slot 606 of the guide pulley mount assembly 604 and cooperate to restrain the lateral displacement of each belt of the pair of center turnover belts 584. The pair of center turnover belts 584 subsequently pass around a turnover conveyor input pulley 608 in a clockwise direction. The turnover conveyor input pulley 608 is rotatably mounted in a pair of bearings 610 that is fixedly attached to the top of the interface bearing blocks 496. The pair of center turnover belts 584 then proceeds upwardly and around a set of idler and takeup pulleys 612.

The set of idler and takeup pulleys 612 is rotatably mounted between the pair of center conveyor input arms 150R and 150L, the pair of center conveyor input members 116 and 116L, the pair of bottom corner braces 118 and 118L, the pair of center output risers 110, the pair of top corner braces 119 and 119L, and between the pair of center conveyor output members 114 to form a semicircular arc therefrom as is shown in FIG. 3. Therefore, the inner two rows of cartons 218 (FIG. 7) of the quadruple streams of cartons 24 are compressively held between the pair of center turnover belts 584 and the set of idler and takeup pulleys 612 (FIG. 3) as they are transported from the exit of the table conveyor 14 to the exit of the pair of center turnover conveyors 34 (FIG. 1). The cartons exit the table conveyor 14 face up and with trailing edges overlapping leading edges, that is, a tucked under shingle, and exit the pair of center turnover conveyors 34 traveling in the opposite direction with the inner two rows of cartons 218 face down and leading edges overlapping trailing edges.

The pair of center turnover belts 584 (FIG. 3) reverses direction in a clockwise rotation about a center turnover output pulley 614 that is rotatably held between the input ends of a pair of center conveyor radius arms 616. The pair of center conveyor radius arms 616 is pivotally mounted at the top of the center output risers 110 by means of a pair of bolts 618. The pair of center conveyor radius arms 616 pivot slightly upward to release compressive forces that build up on the inner two rows of cartons 218 at the output portion of the pair of center turnover conveyors 34.

The pair of center turnover belts 584 passes horizontally toward the output end of the center turnover frame 42 to a pair of top rear idler takeup pulleys 620, each of which is rotatably held on a pair of idler eyebolt assemblies 622. A center eyebolt mount 624 (FIGS. 3 and 4) for the idler eyebolt assemblies 622 is rigidly affixed to the output face of the top output lateral brace 120. Each of a pair of outer eyebolt mounts 626 is rigidly affixed adjacent to the outside output corner of the pair of center output risers 110 by means of a pair of mount blocks 628. The construction of the idler eyebolt assemblies 622 is similar to that of the idler eyebolt assemblies 477, as was previously described with respect to FIGS. 1A and 1B.

The pair of center turnover belts 584 descends vertically after a clockwise turn over the pair of top rear idler takeup pulleys 620, each belt passing between a pair of guide pulleys 630 rotatably mounted in a guide pulley mount assembly 632 that is similar in construction to the guide pulley mount assembly 487 that was previously described in FIGS. 1C and 1D. The guide pulley mount assembly 632 differs insofar as it incorporates only one slot and is attached to the outside surfaces of the pair of center output risers 110. The pair of guide pulleys 630 that associates with each belt of the pair of center turnover belts 584 cooperates to hold the belts in lateral spaced relationship with respect to the center turnover frame 42.

The pair of center turnover belts 584 subsequently descend into a takeup assembly 634. The takeup assembly 634 incorporates an input idler 636, a pair of idler and takeup rolls 638 and an output idler 640. The input idler 636 is rotatably mounted between a pair of input idler brackets 642 rigidly affixed to the inside surfaces of a pair of input idler mount brackets 644. The pair of input idler mount brackets 644 is fixedly attached to the outside surfaces of the pair of center output risers 110 in such manner that the pair of input idler brackets 642 is in longitudinal alignment therewith. Each of idler and takeup rolls 638 is rotatably mounted in a pair of idler eyebolt assemblies 646 that is similar in construction and mounting to that of pair of idler eyebolt assemblies 622 that was previously discussed. The output idler 640 is rotatably mounted between a pair of output idler brackets 648 that is rigidly affixed to the inside surfaces of a pair of output idler mount brackets 650. The pair of output idler mount brackets 650 is fixedly attached to the pair of center output risers 110 in the same manner as that of the pair of input idler mount brackets 644. The pair of center turnover belts 584 passes in a clockwise rotation around the input idler 636, in a counter clockwise rotation around the pair of idler and takeup rolls 638, and clockwise over the output idler 640 with respect to FIG. 3. The pair of center turnover belts 584 then descends vertically to the center conveyor drive roll 586 to complete the belt routing of the pair of center turnover conveyors 34.

The pair of short turnover conveyors 36 is shown in detail in FIGS. 3 and 4, and incorporates the short turnover frame 44 and a pair of short turnover conveyor belts 654. The short turnover frame 44 has been previously described in detail with respect to the basic framework 32 and will be referred to where appropriate. The pair of short turnover conveyor belts 654 is mounted and made mobile upon the short turnover frame 44 by means of a series of rollers and pulleys to be described herein. The pair of short turnover belts 654 rotates in a clockwise direction with respect to FIG. 3 around a short conveyor drive roll 656. The short conveyor drive roll 656 is rotatably mounted adjacent to the pair of top stringers 48R and 48L and adjacent to the pair of short turnover posts 58 in a manner similar to that of the center conveyor drive roll 586 as previously described.

The pair of short turnover belts 654 depart the short conveyor drive roll 656 vertically to ascend to a pair of tapered idler rolls 658. The pair of tapered idler rolls 658 is rotatably mounted on a pair of idler eyebolt mount assemblies 660R and 660L. The right hand idler eyebolt assembly 660R incorporates a short lateral shaft 662, a pair of eyebolts 664R and 664L and a pair of eyebolt mounts 666R and 666L. The short lateral shaft 662 is fixedly held in lateral spaced relationship within the eyes of the pair of eyebolts 664R and 664L. The right hand eyebolt 664R is adjustably mounted through the vertical flange of the right hand eyebolt mount 666R. The right hand eyebolt mount 666R is in turn rigidly affixed to the top surface of the right hand top stringer 48R as is shown in FIGS. 3 and 4. The shaft of the right hand eyebolt 664R points toward the output end of the basic framework 32. In a similar manner, the left hand eyebolt 664L (FIG. 4) is adjustably mounted through the vertical flange of the left hand eyebolt mount 666L which is in turn rigidly affixed to the top surface of the short turnover lateral mount 70. The eyes of the pair of eyebolts 664R and 664L are laterally aligned although the shaft of the left hand eyebolt 664L is directed toward the input end of the basic framework 32. The left hand idler eyebolt assembly 660L is similar in structure to, but mounted in a mirror image from, the right hand idler eyebolt assembly 660R.

Each of the pair of short turnover belts 654 extends horizontally forward to pass between a pair of guide pulleys 668 that is rotatably mounted in an input slot 670 of the guide pulley mount assembly 604 that has been previously described. The pair of guide pulleys 668 provides a means for holding each of the pair of short turnover conveyor belts 654 in lateral spaced relationship with respect to the basic framework 32. The pair of short turnover conveyor belts 654 subsequently reverses its direction of travel in a clockwise rotation (FIG. 3) about the turnover conveyor input pulley 608.

Proceeding now in the direction of carton flow, the pair of short turnover conveyor belts 654 move upwardly and around a set of idler and takeup pulleys 672. The set of idler and takeup pulleys 672 are rotatably mounted between the pairs of short conveyor input arms 152R and 152L and the center conveyor input arms 150R and 150L respectively, between the pairs of outer input risers 130R and 130L and the right and left hand members of the center input risers 112, and between the pairs of outside output arms 146 and the inside output arms 148, to form a small semicircular arc therefrom as is shown in FIG. 3. Therefore, the outer rows of cartons 220 (FIG. 1) of the quadruple stream of cartons 24 are compressively held between the pair of short turnover conveyor belts 654 and the set of idler and takeup pulleys 672 as they are transported from the exit of the table conveyor 14 where the cartons are face up to the exit of the pair of short turnover conveyors 36 where the cartons are face down and traveling in the opposite longitudinal direction. Each belt of the pair of short turnover conveyor belts 654 again reverses longitudinal direction in a clockwise rotation about a short turnover conveyor output pulley 674.

In the following discussion, the description of parts associated with the right hand conveyor of the pair of short turnover conveyors 36 will apply equally to the left hand conveyor of the pair of short turnover conveyors 36 with the exception that appropriate mountings will be a mirror image of each other. Each of the short turnover conveyor output pulleys 674 is rotatably mounted between the input ends of an outside radius arm 676 and an inside radius arm 678. The outside radius arm 676 is pivotally held at the top of the right hand outer input riser 130R by means of a bolt 680. The inside radius arm 678 is pivotally attached in lateral alignment with the bolt 680 to the inside surface of the right hand member of the pair of center input risers 112. This pivotal mount provides the short turnover conveyor output pulley 674 with a vertical degree of freedom so that the compressive force between the short turnover conveyor belt 654 and the set of idler and takeup pulleys 672 can be maintained at a proper preset level. The pair of short turnover conveyor belts 654 passes horizontally from the short turnover conveyor output pulleys 674 to a pair of idler and takeup pulleys 682R and 682L. The pair of idler and takeup pulleys 682R and 682L is rotatably mounted on a pair of idler eyebolt assemblies 684R and 684L similar in construction to the pair of idler eyebolt assemblies 622 of the pair of center turnover conveyors 34 as previously described. After a clockwise turn around the pair of idler and takeup pulleys 682R and 682L the pair of short turnover conveyor belts 654 descends to complete the belt cycle at the short conveyor drive roll 656.

Referring to FIGS. 1, 3 and 4, power is delivered to the drive roll 586 of the pair of center turnover conveyors 34 by means of drive sprocket 686 that is rigidly affixed at the right hand end of the center conveyor drive shaft 588. Power is also delivered to the short conveyor roll 656 by means of a short conveyor drive sprocket 688 that is rigidly affixed at the right hand end of a short conveyor drive shaft 690. As can be seen in FIG. 1, a turnover conveyor gear box 692 is fixedly mounted on the roll over bottom brace 74. Gearing (not shown) in the gear box 692 is driven by a shaft 6921. The shaft 6921 is coupled to a longitudinal shaft 6922 of the gear box 518. The shaft 6922 is also coupled to the shaft 5181 so that the gear boxes 412, 518, and 692 are all driven in timed relation to the cutting rolls 22. A gear box sprocket 694 cooperates with a turnover drive chain 696 that in turn circumscribes the drive sprocket 686 of the center turnover conveyors 34 and the short conveyor drive sprocket 688. An idler sprocket 700 (FIG. 1) is supported above the turnover conveyor gear box 692 and cooperates with the turnover drive chain 696 to maintain tension therein. In this manner motive power is delivered to the pair of center turnover conveyors 34 and the pair of short turnover conveyors 38, both of which move at the same speed and in timed relation to the cutting rolls 22. Preferably, the turnover conveyors 34 and 38 deliver cartons at a speed which is 25% of the speed at which the cutting rolls 22 deliver cartons.

The Set of Four Cross Conveyors

The set of four cross conveyors 20 (FIG. 1) incorporates a pair of top cross conveyors 702R and 702L and a pair of bottom cross conveyors 704R and 704L as is indicated in FIG. 2. All four conveyors of the set of four cross conveyors 20 are similar in construction, save for right and left hand parts, and differences in mounting that will be described hereinafter. The left hand bottom cross conveyor 704L will be described in detail herein.

Figure 16:
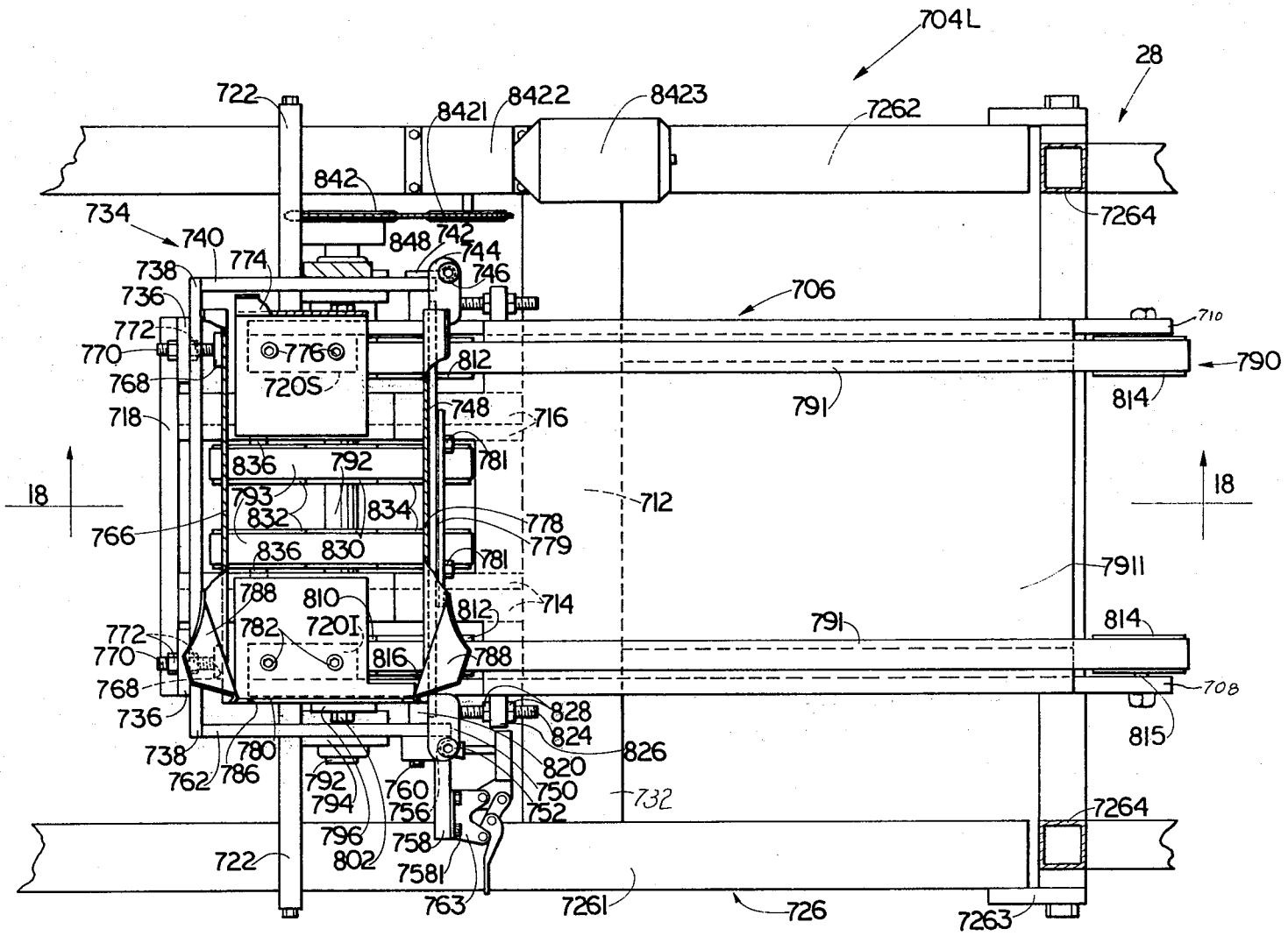
FIG. 16 is an enlarged plan view of one of the cross conveyor hoppers and conveyor sections of the machine, a portion of a main hopper being shown in association therewith, parts being broken away to reveal details of construction.
Figure 17:
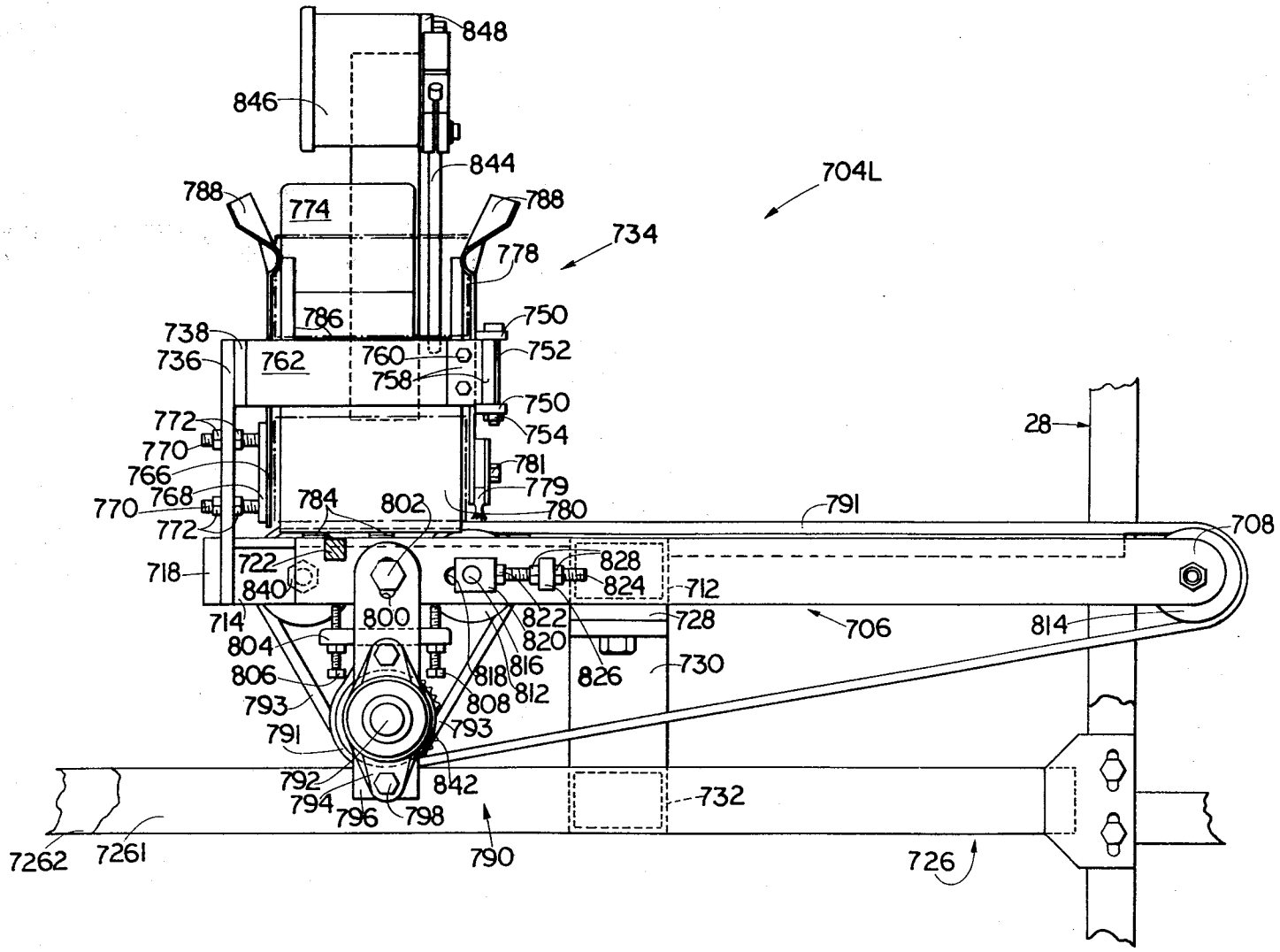
FIG. 17 is an enlarged view in side elevation of the cross conveyor hopper and conveyor section of the machine shown in FIG. 16.
Figure 18:
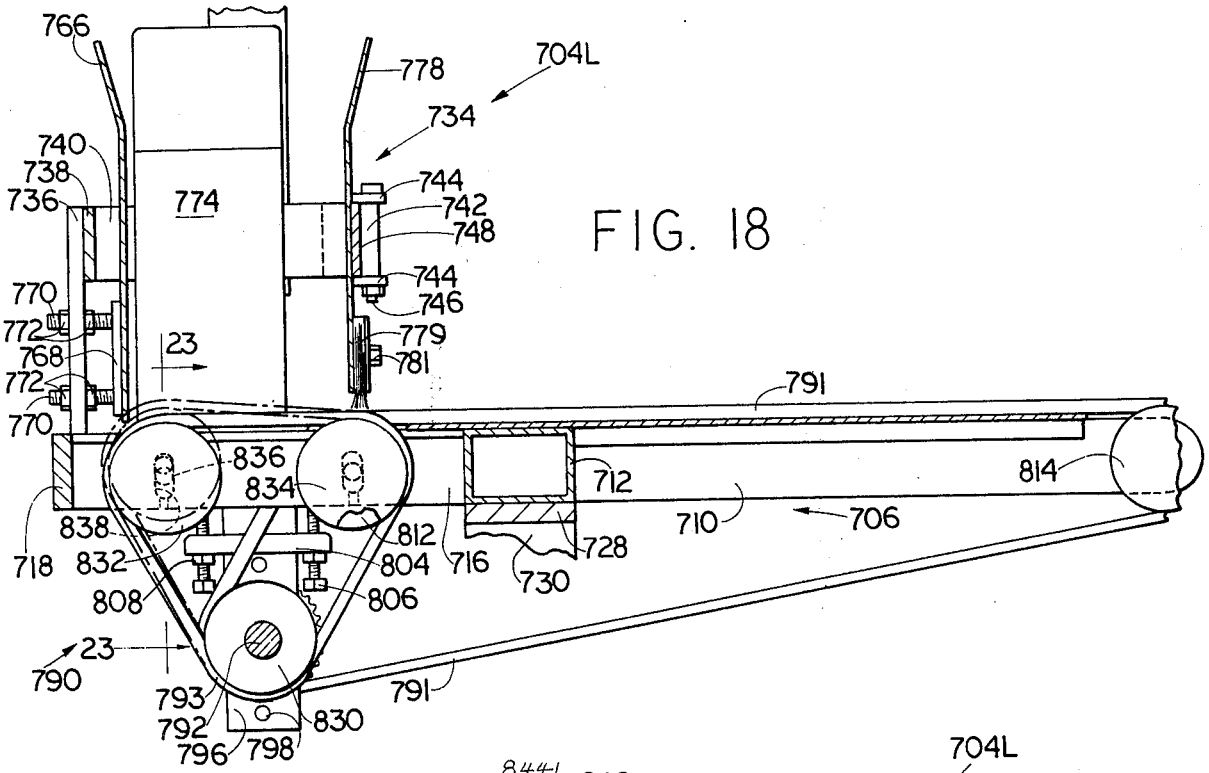
FIG. 18 is an enlarged view in section taken on the line 18—18 in FIG. 16.
Figure 19:
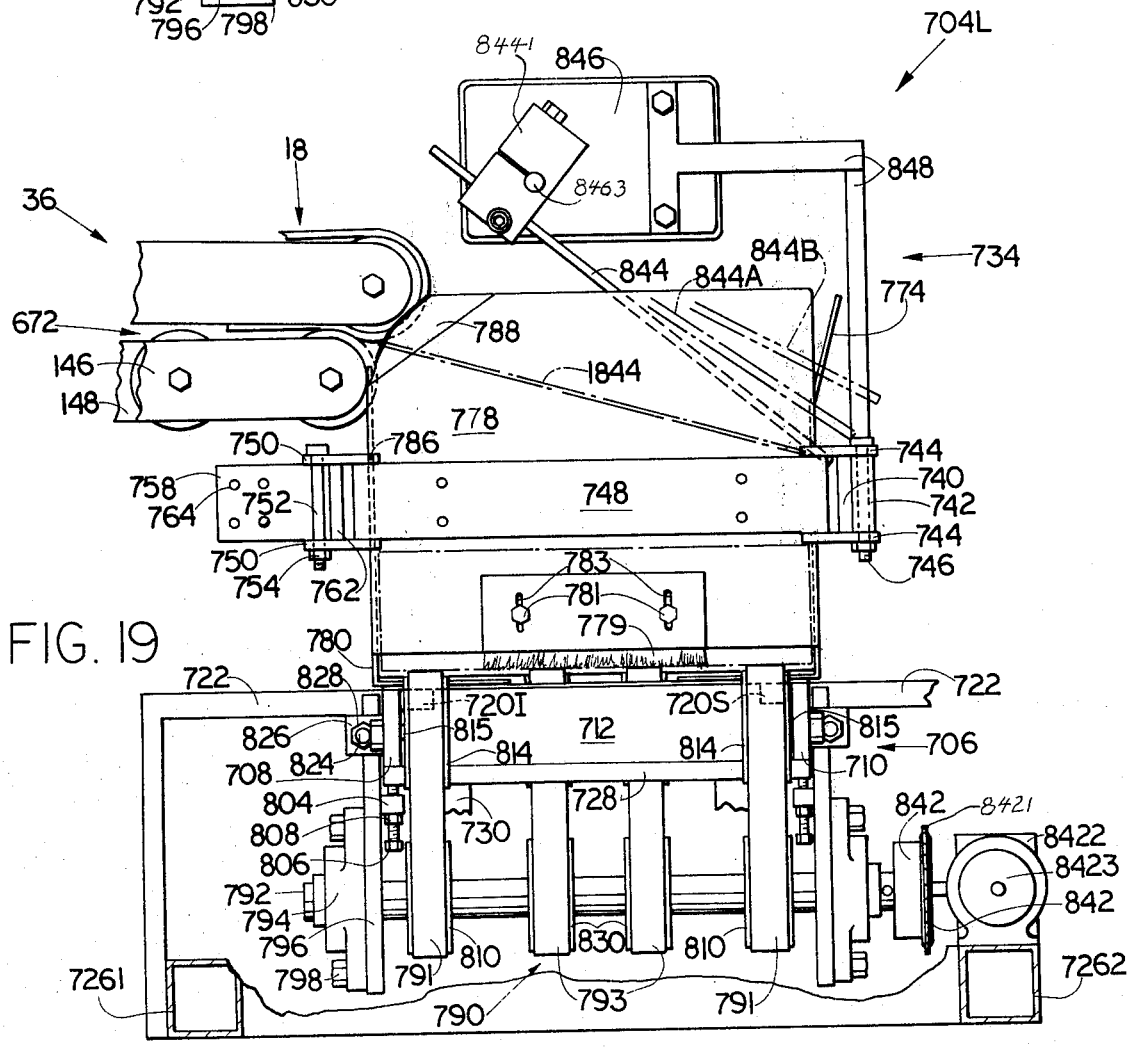
FIG. 19 is an enlarged view in end elevation of one of the cross conveyor hopper and conveyor sections of the machine, shown in relationship with the exit of an associated turnover conveyor section of the machine.
Figure 20:
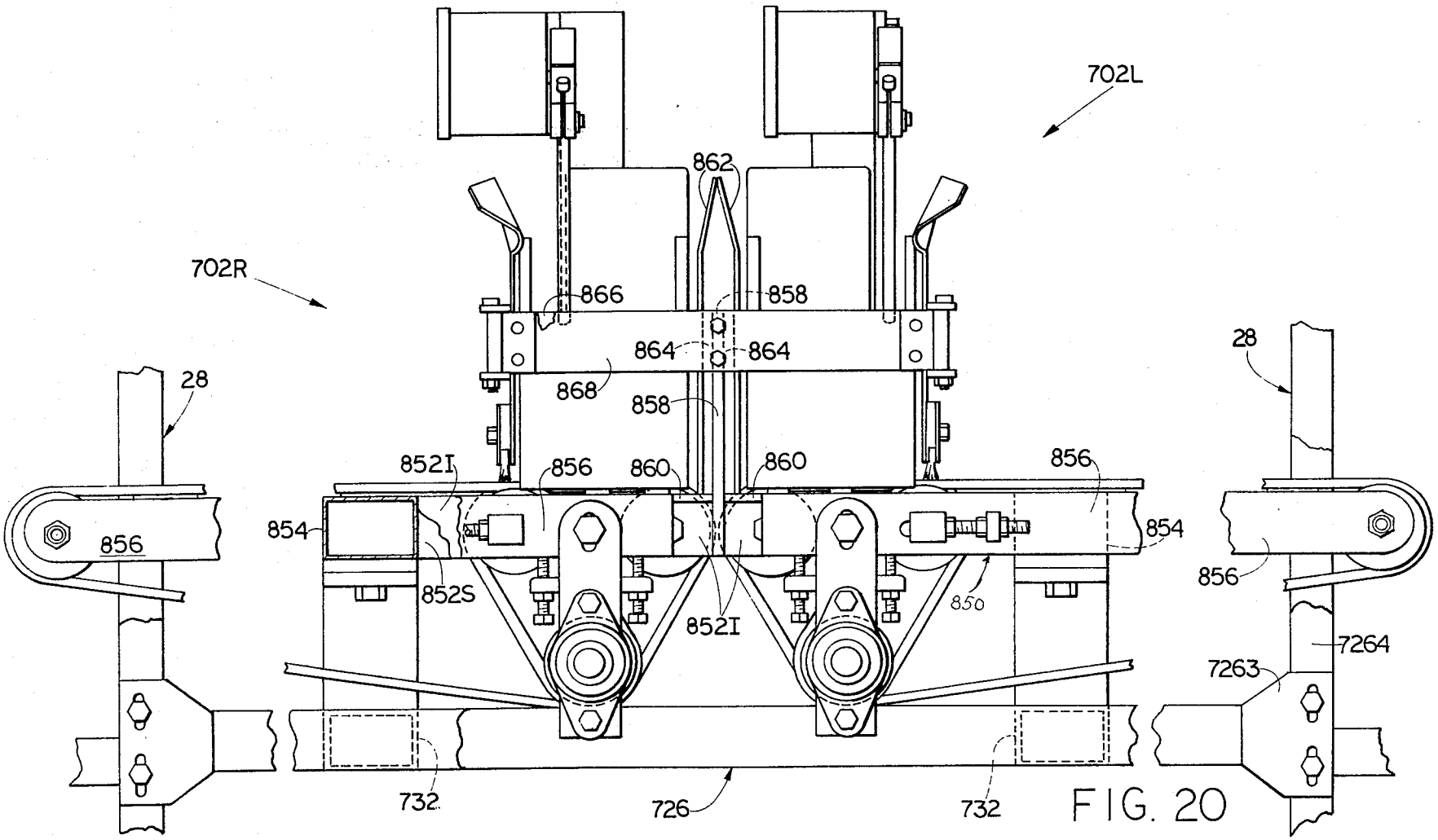
FIG. 20 is an enlarged view in side elevation of two hopper and conveyor sections of the machine jointed into one unit, fragmentary portions of two main hoppers and a support bracket being shown in association therewith.

The left hand bottom cross conveyor 704L, as shown in FIGS. 16, 17, 18, and 19, incorporates a basic frame structure 706. The basic frame structure 706 incorporates an input side rail 708, and a stop side rail 710 (FIG. 16) that are rigidly affixed in horizontal spaced relationship by means of a spacer tube 712. An input hopper rail 714 and a stop hopper rail 716 are rigidly affixed in a cantilever manner from the input face of the spacer tube 712 as is best shown in FIGS. 16 and 18. The terminology of right and left side, of input and output, and of longitude and lateral will henceforth herein be used with respect to the local line of carton flow. Cartons move from left to right in FIGS. 16, 17 and 18. The input ends of the input hopper rail 714 and the stop hopper rail 716 are fixedly fitted with a laterally disposed hopper mount plate 718 (FIG. 16). Also, the input end portions of the stop side rail 710 and the input side rail 708 incorporate hopper mounting plates 720S and 720I, respectively, rigidly affixed to the inside surfaces thereof. Lateral bridge support brackets 726 support the cross conveyors. As shown in FIG. 20, each bridge support bracket 726 spans the basic framework 32 and is rigidly affixed between the structure of the pair of vertical hoppers 28. As shown in FIGS. 16 and 17, each bridge support bracket includes a pair of spaced transverse members 7261 and 7262. Ends of the transverse members 7261 and 7262 carry plates 7263 which are attached to uprights 7264 of the hoppers 28. Horizontal mount tubes 732 span the transverse members 7261 and 7262. Referring to FIGS. 17, 18 and 19, the spacer tube 712 is fixedly attached to a conveyor frame mount plate 728. The conveyor frame mount plate 728 (FIG. 1) is rigidly affixed across the top of a pair of cross conveyor posts 730 that are in turn rigidly affixed on top of one of the horizontal mount tubes 732. Angle shaped guard support brackets 722 are attached to the bridge supports 726.

The basic frame structure 706 provides mounting structure for a cross conveyor hopper 734 as shown in FIGS. 16 and 19. The cross conveyor hopper 734 incorporates a pair of side plate mounts 736, shown in FIGS. 17–18, rigidly affixed in a vertical dispostion to end portions of the hopper mount plate 718. A horizontal side plate mount 738 is rigidly affixed across the top of the pair of side plate mounts 736. Rigidly affixed in a perpendicular manner to the horizontal side plate mount 738 is a door hinge mount 740. The output end of the door hinge mount 740 fixedly incorporates a hinge case 742 as is shown in FIGS. 16, 18 and 19. As can be seen, a pair of hinges 744 cooperate with a hinge pin 746 that is inserted in the hinge case 742 to provide pivotal freedom to a door mount 748. The free end of the door mount 748 incorporates a pair of lock lugs 750, as shown in FIGS. 16, 17 and 19. The pair of lock lugs 750 carry a lock bolt 752 that passes through a pair of clear holes in the pair of lock lugs 750, and is held firmly in place by a nut 754. As the door mount 748 swings clockwise with respect to FIG. 16, the lock bolt 752 comes to rest in a groove 756 that is an integral feature of an L shaped clamp mount 758 that is fixedly attached by means of a pair of bolts 760 to a door latch mount 762. The door latch mount 762 is rigidly affixed to the input end of the horizontal side plate mount 738. The lock bolt 752 is compressively held in the groove 756 of the L-shaped clamp mount 758 by means of an off-centered clamp 763 that is fixedly attached to the L-shaped clamp mount 758 by the function of fasteners 7581 received in a set of four tapped holes 764 provided therein as is shown in FIG. 19.

An adjustable side plate 766 is rigidly affixed to a pair of vertical mounting bars 768 as is shown in FIGS. 16 to 18. Each of the bars 768 fixedly incorporates, in a perpendicular orientation, a pair of adjusting rods 770. Each adjusting rod 770 passes through a clear hole in one of the pair of side plate mounts 736 and is fixedly attached in proper placement by a pair of lock nuts 772. A stop plate 774 is fixedly attached by means of a pair of flat head machine screws 776 (FIG. 16) to the hopper mounting plate 720S. The stop plate 774 is shimmed into vertical position by means of washers (not shown) that are placed between the hopper mounting plate 720S and the bottom of the stop plate 774. A door side plate 778 is fixedly attached to the input side of the door mount 748. A brush discriminator 779 (FIG. 19) is attached to the outside surface of and at the bottom edge of the door side plate 778. The brush discriminator 779 is vertically adjustable upon the door side plate 778 by means of a pair of cap screws 781 that cooperate with a pair of slots 783 as is clearly shown in FIG. 19. The cross conveyor hopper 734 is completed with an input plate 780 that is fixedly attached to the input hopper mounting plate 720I by means of a pair of flat head machine screws 782 (FIG. 16). The input plate 780 is shimmed into proper vertical spaced relationship with respect to the cross conveyor hopper 734 by means of washers 784 as shown in FIG. 17. The input plate 780 incorporates a cutout 786

(FIG. 17) to provide physical clearance for the output ends of the left side member of the pair of short turnover conveyors 36, as is shown in FIG. 19. The adjustable side plate 766 and the door side plate 778 each incorporate at the top input edge corners, a flared leading edge 788 to facilitate the entry and alignment of cartons from the roll over conveyor 18.

The basic frame structure 706 provides mounting structure for a set of four timing belts 790 that cooperates in supplying motive force to transport cartons from the cross conveyor hopper 734 to the appropriate vertical hopper of the pair of vertical hoppers 28 as shown in FIGS. 1 and FIGS. 16–19. The set of four timing belts 790 is comprised of a pair of cross conveyor belts 791 and a pair of hopper belts 793. The set of four belts 790 receives power from a common drive shaft 792. The common drive shaft 792 is rotatably held in a pair of bearings 794 that is fixedly attached to a pair of adjusting mounts 796 by means of a pair of cap screws 798. Each mount of the pair of adjusting mounts 796 incorporates an elongated hole 800 at its upper end as is shown in FIG. 7. As can be seen, a cap screw 802 passes through the elongated hole 800 and is threadably mounted in its respective input side rail 708 or stop side rail 710. This clamping method permits vertical and angular adjustment of the pair of adjusting mounts 796. To facilitate the necessary adjustments of the pair of adjusting mounts 796, a setting bolt mount 804 is rigidly affixed in a perpendicular relationship across the inside surface of each of the pair of adjusting mounts 796. A pair of setting bolts 806 is threadably mounted through the ends of each of the pair of adjusting mounts 796 and is fixedly held in place by means of a pair of lock nuts 808 (FIGS. 17, 18 and 19). With the lock nuts 808 disengaged, the pair of setting bolts 806 can be turned clockwise to apply pressure against the bottom surface of the input side rail 708 or the stop side rail 710, whichever is applicable, to forceably bring into tension the pair of hopper belts 793. Referring to FIG. 17, the right hand member of the pair of setting bolts 806 is further turned inwardly to provide a clockwise rotation of each of the members of the pair of adjusting mounts 796 to provide tension within the pair of cross conveyor belts 791. When the adjustments have been made, the two cap screws 802 are tightened to compressively hold the pair of adjusting mounts 796 in fixed relationship with respect to the input side rail 708 and the stop side rail 710. The two pairs of lock nuts 808 are also set into place.

A pair of cross conveyor drive pulleys 810 is rigidly affixed to the common drive shaft 792 as is best shown in FIG. 19. The pair of cross conveyor drive pulleys 810 carries the pair of cross conveyor belts 791, each of which circumscribes one of a pair of pickup pulleys 812 and one of a pair of output pulleys 814. The pair of pickup pulleys 812 is rotatably mounted on a pair of pickup stub shafts 816, as can be seen in FIGS. 16 and 17. The pair of pickup shafts 816 passes through clear slots 818 in the input side rail 708 and the stop side rail 710 to be rigidly affixed within a pair of slide blocks 820. Rigidly affixed to the output side of each of the pair of slide blocks 820 is a nut 822. A threaded shaft 824 is fixedly attached within the nut 822 and passes longitudinally through a clear hole in one of a pair of pickup adjusting blocks 826. Each of the adjusting blocks 826 is mounted on one of the side rails 708 and 710. Each of the threaded shafts 824 carries a pair of lock nuts 828 that provides longitudinal placement and fixed retention of the pair of pickup pulleys 812. In so doing, a degree of longitudinal adjustment is provided to the pickup end of the cross conveyor belts 791 to cooperate with the various requirements of cartons collected within the cross conveyor hopper 734. What is referred to as varying requirements is the degree of warp that is present in the cartons of a given job. Each of the pair of output pulleys 814 is rotatably mounted on an output shaft 815 (FIG. 16) that is in turn rigidly affixed within the output end of the associated end of the input side rail 708 and the stop side rail 710.

Figure 23:
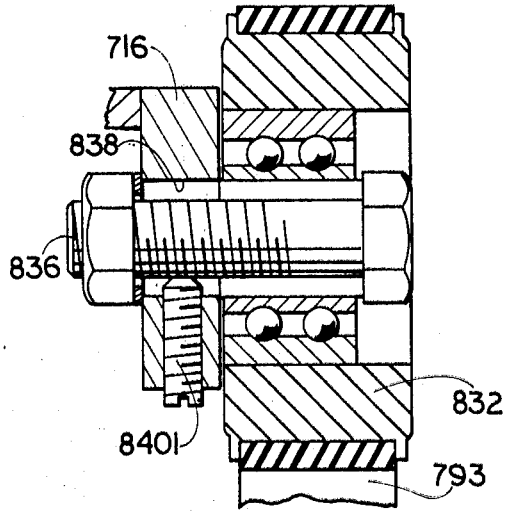
FIG. 23 is a view in section taken on an enlarged scale on the line 23—23 in FIG. 18.

The pair of hopper belts 793 is most clearly shown in FIGS. 18 and 19. A pair of hopper belt drive pulleys 830 is rigidly affixed to the common drive shaft 792. The pair of hooper belt drive pulleys 830 carries the pair of hopper belts 793. Each of the hopper belts 793 circumscribes one of a pair of kickoff pulleys 832 and one of a pair of transfers pulleys 834. Each of the pair of kickoff pulleys 832 (FIGS. 16 and 18) is rotatably mounted on one of a pair of kickoff shafts 836 each of which passes through a clear vertical slot 838. The slots 838 are incorporated into the input ends of the input hopper rail 714 and the stop hopper rail 716. As is indicated in FIG. 17, the pair of kickoff shafts is boltedly fastened within the clear vertical slots 838 by means of a pair of nuts 840 that provides a vertical degree of adjustment to the pair of hopper belts 793 as shown in dot-dash lines in FIG. 18. As shown in FIG. 23, an upright screw 8401 threaded in the hopper rail 716 bears on the shaft 836 to position the shaft in the slot 838. In this manner, the pair of hopper belts 793 can be adjusted to cooperate with varying degrees of carton warpage. In like manner, the pair of transfer pulleys 834 is vertically adjustable in its respective mountings. The vertical adjustments of the pair of hopper belts 793, in cooperation with the pair of cross conveyor belts 791, provide a means for supporting the cartons at three points, not four, with the belts 793 supporting the cartons at substantially one point and the belts 791 support the cartons at spaced points. This suspension system will insure proper kickoff through the brush discriminator 779, whereas a four-point suspension system could miss kicking the carton completely, but more likely would kick the carton out of alignment as it passes under the brush discriminator 779. The cartons are thereby fed through the brush discriminator 779 by means of the pair of hopper belts 793 and delivered in a close shingle to the vertical hopper of the pair of vertical hoppers 28 by the pair of cross conveyor belts 791. The belts 791 run on a table 7911 which spans the rails 708 and 710. The table 7911 terminates short of the pulleys 814.

Power is supplied to the common drive shaft 792 through a drive sprocket 842 (FIG. 19) that is rigidly attached to one end of the common drive shaft 792. Power is delivered to the drive sprocket 842 through a drive chain 8421 and a gear box 8422, from a motor 8423. The gear box 8422 is mounted on the transverse member 7262. The motor 8423 is supported on the gear box 8422. The speed of this motor, and consequently the speed of the set of four timing belts 790 is controlled by a sensing finger 844 that extends downwardly into the cross conveyor hopper 734 as is best shown in FIG. 19. A carton 1844, shown in dot-dash lines in the figure, is depicted entering the cross conveyor hopper 734 from the rollover conveyor 18. As the carton 1844 strikes the sensing finger 844, its leading edge is deflected downward while its trailing edge is momentarily guided by the flared leading edge 788 of the adjustable side plate 766 and the door side plate 778. The carton subsequently falls to the bottom of the cross conveyor hopper 734. As the sensing finger 844 rotates counterclockwise in FIG. 19 due to more cartons piling up within the cross conveyor hopper 734, the set of four timing belts 790 is driven faster to continuously deliver the cartons to the vertical stacker as required. The sensing finger 844 is pivotally mounted to a rate switch 846 that is fixedly attached to a switch bracket 848. The switch bracket 848 is rigidly affixed to the door hinge mount 740 as is shown in section in FIG. 19.

Figure 27:
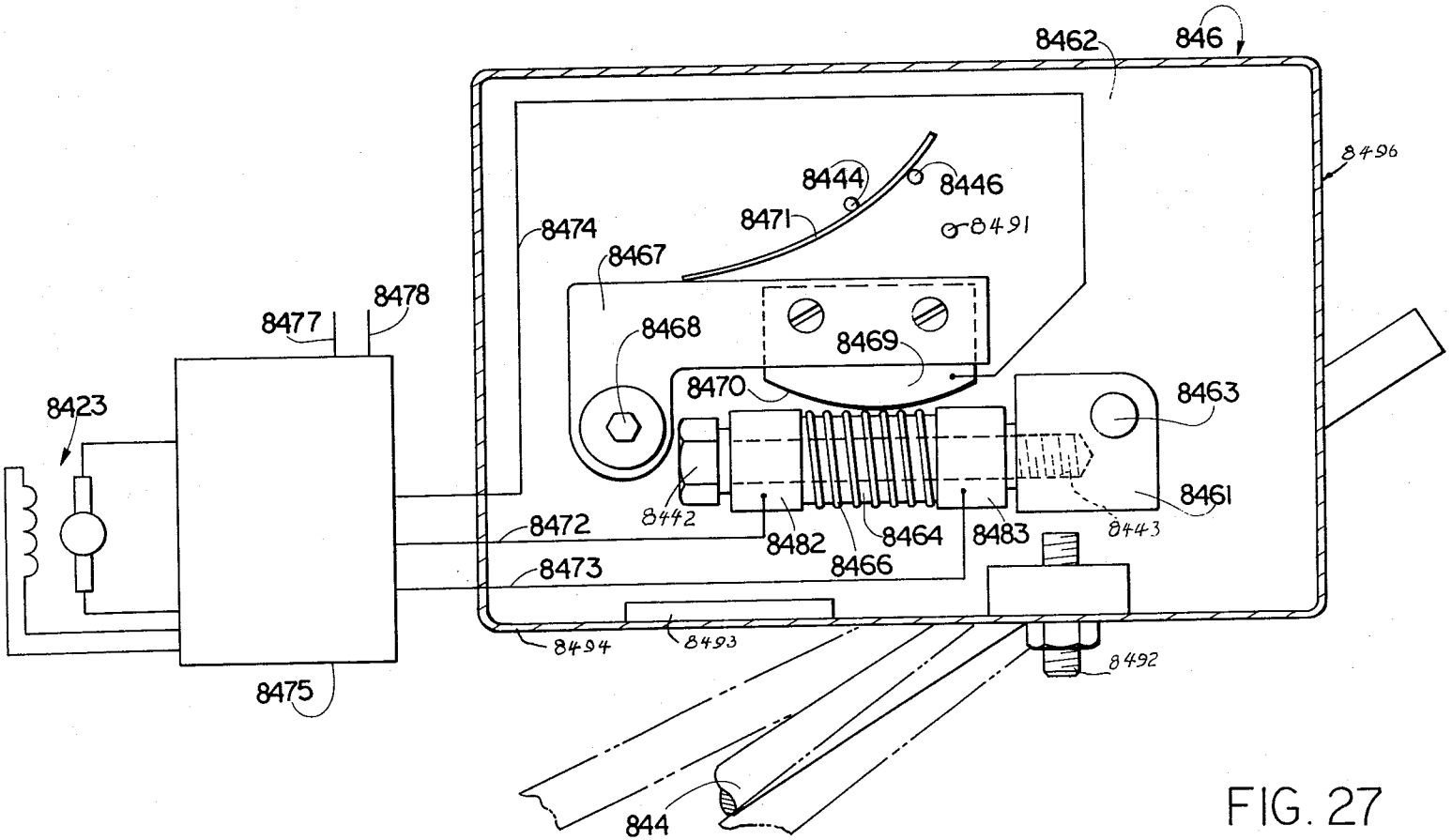
FIG. 27 is a view in upright section of a rate switch of the machine, electrical connections thereto being shown schematically.

As shown in FIG. 27, the rate switch 846 includes a resistor support 8461, which is pivotally supported on a backing plate 8462 to swing about a pivot 8463. The pivot 8463 also supports a bracket 8441 (FIG. 19) on which the sensing finger 844 is mounted. The support 8461 (FIG. 27) has a tubular insulator 8464 on which a resistance wire 8466 is helically wound. A bolt 8442 extends through the insulator 8464 and is received in a socket 8443 in the resistor support 8461. A contact support insulator 8467 is pivotally mounted on the plate 8462 to swing about a pivot 8468. A contact element 8469 having an arcuate face 8470 is mounted on the contact support 8467. A leaf spring 8471 urges the contact element 8469 into engagement with the resistance wire 8466. Pins 8444 and 8446 mounted in the plate 8426 support the leaf spring 8471. Leads 8472 and 8473 are connected to caps 8482 and 8483, respectively, which are connected to ends of the resistance wire 8466. A lead 8474 is connected to the contact element 8469. As the sensing finger 844 swings between the full line position, the dash-dot line position and the double-dot-dash line positions of FIG. 27, the resistance between the lead 8474 and the leads 8472 and 8473, respectively, is varied. These leads are connected to a motor control device 8475 (not shown in detail), which can be of the type known as a Boston Gear Rapidtrol, a trademark of Boston Gear Division of Rockwell International Corp. The control device 8475 controls the speed of the motor 8423. Power is supplied to the control device 8475 through power leads 8477 and 8478. A pin 8491 mounted on the backing plate 8462 limits upward swinging of the contact support insulator 8467. An adjustable slot 8492 is engageable by the resistor support 8461 to limit downward swinging thereof. A resilient pad 8493 of neoprene of other rubber-like material is mounted on a lower wall 8494 of a casing 8496 of the rate switch 846 and can be engaged by the head of the bolt 8442 to prevent engagement with the casing 8496. When the sensing finger 844 reaches the dot-dash position indicated at 844A in FIG. 19, the motor 8423 is driven at a speed to cause delivery of cartons by the belts 791 at the same speed as cartons are normally delivered into the cross conveyor hopper 734. When the sensing finger swings downwardly, the motor 8423 is progressively slowed until it reaches the full line position at which the motor 8423 is stopped. When the sensing finger 844 is raised above the dot-dash line position, the motor is driven at progressively higher speeds until a maximum speed is reached when the sensing finger reaches the double-dot-dash line position indicated at 844B at which the cartons are removed from the cross conveyor hopper 734 at approximately 125% of the rate at which cartons are normally delivered thereto. Thus, a substantially constant level of cartons is maintained in the cross conveyor hopper so that cartons are removed therefrom without distortion of the stream of cartons.

The pair of bottom cross conveyors 704R and 704L are separately mounted in mirror image orientation upon a lower one of the pair of lateral bridge supports 726 (See FIG. 1). The pair of top cross conveyors 702R and 702L are substantially identical in construction to the pair of bottom cross conveyors 704R and 704L, except that they are mounted as Siamese twins, as is shown in FIG. 20. Their common parts will be described herein.

A basic frame structure 850 incorporates an input hopper belt mount 852I and a stop hopper belt mount 852S. A pair of cross conveyor spacer bars 854 is fixedly attached to the ends of the input hopper belt mount 852I and the stop hopper belt mount 852S. Fixedly attached to the four ends of the pair of cross conveyor spacer bars 854 is a set of four cross conveyor rails 856. The set of four cross conveyor rails 856 is longer than the input side rail 708 and the stop side rail 710 of the left hand bottom cross conveyor 704L as previously described, to cooperate in getting the inner two rows of cartons 218 to the pair of vertical hoppers 28. Rigidly affixed in a vertical disposition at the center of the input hopper belt mount 852I and the stop hopper belt mount 852S, is a pair of common side plate mounts 858. The input hopper belt mount 852I and the stop hopper belt mount 852S are strengthened by the addition of a set of four hopper flanges 860 that butt against each of the common side plate mounts 858. Each member of a pair of center side plates 862 is rigidly affixed to a mount bar 864. Each of the mount bars 864 is horizontally and rigidly affixed across the top of the pair of common side plate mounts 858. A common door hinge mount 866 is horizontally attached at the top of the stop member of the pair of common side plate mounts 858, and in similar manner, a common door latch mount 868 is horizontally attached at the top of the input member of the pair of common side plate mounts 858. The remaining parts of the pair of top cross conveyors 702R and 702L are similar to those of the pair of bottom cross conveyors 704R and 704L. The pair of top cross conveyors 702R and 702L are mounted to an upper one of the pair of lateral bridge supports 726 in a manner similar to that in which the pair of bottom cross conveyors 704R and 704L is attached to the lower one of the lateral bridge supports 726 (FIG. 1). Consequently, the set of four cross conveyors 20 delivers the quadruple streams of cartons 24 in four stacks of cartons to the pair of vertical hoppers 28.

As shown in FIG. 24, each of the cross conveyors 20 delivers its stream of cartons 24 into the associated hopper 28 against stop members 901 and 902 which are mounted on the framework of the hopper 28. The cartons accumulate in the hopper 28 on an appropriate support member or tongue 903, which is part of the mechanism of the hopper and moves downwardly in the hopper as cartons collect thereon. The mechanism of the hopper can be similar to that shown and described in Runyan et al. co-pending application Ser. No. 258,180, filed May 31, 1972. Movement of hopper elements is controlled by a control valve 906, which is supported on a frame 905. The cartons 24 collect in a stack 907 on the tongue 903 and the cartons are delivered onto the stack 907 under a control arm 908. The control arm 908 is pivotally mounted on a bracket 909 mounted on the hopper framework. A stop arm 910 of the bracket 909 limits upward movement of the control arm 908. The control arm 908 is counterbalanced by a tension spring 911. The control arm 908 is linked to a crank arm 912 by an adjustable link 913. The crank arm 912 is mounted on a shaft 914 rotatably mounted in supports 9141. The shaft 914 carries a second crank arm 916 which is linked to a third crank arm 917 by an adjustable link 915. The crank arm 917 is mounted on a second shaft 918. The shaft 918 is rotatably mounted in supports 919 and is connected to a drive shaft 920 of the control valve 906 by a coupling 921 (FIG. 25) so that, as the control arm 908 swings up and down as shown in FIG. 24, the control valve 906 is actuated thereby.

The quadruple stacker illustrated in the drawings and described above is subject to structural modification without departing from the spirit and scope of the appended claims.

Having described our invention, what we claim as new and desired to secure by letters patent is:

1. In a machine for delivering flat articles, the combination of a hopper, input conveyor means for supplying articles to an upper portion of the hopper, a first hopper conveyor belt means extending transversely of the hopper in the lower portion thereof, the first hopper conveyor means supporting articles in the hopper, a second hopper conveyor means, the second hopper conveyor means including a pair of spaced conveyor belts disposed on opposite sides of the first hopper conveyor means and directed substantially parallel to the first hopper conveyor means, the second hopper conveyor means having a pick-up station adjacent and underlying a side wall of the hopper, the second hopper conveyor means receiving articles from the hopper at the pick-up station, there being an unobstructed space between the belts of the second hopper conveyor means downstream of the first hopper means, and means for driving the first and second hopper conveyor means in a direction to advance articles from the hopper onto the second hopper conveyor means to be delivered thereby.

2. A machine as in claim 1 wherein there is a discriminator adjustably mounted on the side wall of the hopper overlying the pick-up station of the second hopper conveyor means and engageable with cartons as the cartons leave the hopper for forming the cartons into a shingle arrangement on the second hopper conveyor means.

3. A machine as in claim 1 wherein the input coveyor means includes a frame, a plurality of rollers rotatably mounted on the frame, the rollers being arranged in substantially a semi-circle and a turn-over belt conveyor running on the rollers, means for directing cartons to the input conveyor means, and means for driving the turn-over belt to advance the cartons between the turn-over belt and the rollers to cause the cartons to be inverted before being directed into the hopper.

4. A machine as in claim 3 wherein the means for directing cartons to the input conveyor means includes means for arranging the cartons in a stream shingle fashion with the trailing edge of each carton overlying the leading edge of the next succeeding carton, the cartons being delivered by the input conveyor with the trailing edge of each carton underlying the leading edge of the next succeeding carton so that the cartons fall into the hopper when discharged by the input conveyor.

5. A machine as in claim 1 wherein the means for driving the hopper conveyor means includes a variable speed motor, a rate switch controlling the speed of the motor, a sensing finger actuating the rate switch, the sensing finger being arranged to rest on cartons in the hopper, the input conveyor means directing the cartons into the hopper under the sensing finger, the rate switch controlling the motor so that the motor drives the first and second hopper conveyor means at a predetermined speed when the top of a stack of cartons in the hopper is at a predetermined level to deliver cartons onto the second hopper conveyor means at the speed at which the cartons are delivered into the hopper, the rate switch controlling the motor to advance the first and second hopper conveyor means at a greater speed when the level of cartons in the stack is higher than the predetermined level and at a lower speed when the level is lower than the predetermined level, whereby a substantially constant level of cartons is maintained in the hopper overlying the first hopper conveyor means.

6. In a machine for delivering flat cartons, the combination of a hopper, input conveyor means for supplying cartons to an upper portion of the hopper, a first hopper conveyor means including a pair of spaced parallel belt conveyors extending transversely of the hopper in the lower portion thereof, the first hopper conveyor means supporting cartons in the hopper, second hopper conveyor means disposed on opposite sides of the first hopper conveyor means and directed substantially parallel to the first hopper conveyor means, the second hopper conveyor means having a pick-up station adjacent and underlying a side wall of the hopper, the second hopper conveyor means receiving cartons from the hopper, and means for driving the first and second hopper conveyor means in a direction to advance cartons from the hopper onto the second hopper conveyor means to be delivered thereby, the driving means including a drive shaft spaced below the hopper, a plurality of pulley means mounted on the drive shaft, the second hopper conveyor means extending around spaced ones of the pulley means, the first hopper conveyor means extending around other of the pulley means, spaced bearings rotatably supporting the drive shaft, spaced bearing support blocks supported on the hopper and extending downwardly therefrom, means for mounting the bearings on the bearing support blocks, the bearing support blocks being mounted for movement upwardly and downwardly for adjusting the tension in the first hopper conveyor means, the hopper support blocks being mounted for swinging with regard to the hopper to adjust tension in the second hopper conveyor means, and means for turning the drive shaft to advance the conveyor means.

7. A machine as in claim 6 wherein the pulley means are of equal diameter so that the conveyor means are advanced at equal speeds.

* * * * *